US010660464B2

(12) United States Patent
Pepper

(10) Patent No.: US 10,660,464 B2
(45) Date of Patent: May 26, 2020

(54) REUSABLE FOLDABLE DRINKING STRAW IN STORAGE CASE

(71) Applicant: THE FINAL CO. LLC, Santa Fe, NM (US)

(72) Inventor: Miles Pepper, Los Angeles, CA (US)

(73) Assignee: THE FINAL CO. LLC, Santa Fe, NM (US)

( * ) Notice: Subject to any disclaimer, the term of this patent is extended or adjusted under 35 U.S.C. 154(b) by 0 days.

(21) Appl. No.: 16/548,410

(22) Filed: Aug. 22, 2019

(65) Prior Publication Data

US 2019/0374055 A1 Dec. 12, 2019

Related U.S. Application Data

(63) Continuation of application No. 16/186,560, filed on Nov. 11, 2018, which is a continuation of application (Continued)

(51) Int. Cl.
*A47G 21/18* (2006.01)
*B08B 1/00* (2006.01)

(Continued)

(52) U.S. Cl.
CPC ..... *A47G 21/189* (2013.01); *A47L 17/00* (2013.01); *B08B 1/005* (2013.01); *B08B 9/0436* (2013.01); *B65D 81/261* (2013.01)

(58) Field of Classification Search
CPC ..... A47G 21/189; A01G 2013/008; B08B 1/005; B08B 9/0436; A47L 17/00;

(Continued)

(56) References Cited

U.S. PATENT DOCUMENTS 942,306 A 12/1909 Clarke
2,815,981 A 12/1957 Nonnamaker et al.

(Continued)

FOREIGN PATENT DOCUMENTS

JP 2008-99857 A 5/2008
JP 2014-155524 A 8/2014

(Continued)

OTHER PUBLICATIONS

International Search Report for PCT/US18/35621 dated Aug. 29, 2018.

(Continued)

*Primary Examiner* — Kareen K Thomas
(74) *Attorney, Agent, or Firm* — Marshall, Gerstein & Borun LLP

(57) ABSTRACT

A reusable drinking straw that is foldable into a compact configuration for storage and easily transportable in a storage case. The straw comprises a rigid external tube and a flexible internal tubing that is foldable to a compact configuration for storage. In a folded configuration, the reusable straw has a significantly reduced length of approximately one-half to one-fourth of its extended length when in use. The external tube of the straw is preferably formed of multiple rigid segments for supporting the flexible internal tubing in the extended configuration during use as a drinking straw. A simple cleaning device is provided to clean the straw after use. A storage case is provided to store the straw in the folded configuration in a compact form and to store the cleaning device.

18 Claims, 17 Drawing Sheets

Related U.S. Application Data

No. 15/987,681, filed on May 23, 2018, now Pat. No. 10,123,641.

(60) Provisional application No. 62/658,976, filed on Apr. 17, 2018, provisional application No. 62/579,013, filed on Oct. 30, 2017.

(51) Int. Cl.
*B08B 9/043* (2006.01)
*A47L 17/00* (2006.01)
*B65D 81/26* (2006.01)

(58) Field of Classification Search
CPC ..... B65D 81/261; B27K 9/007; A61G 1/013; B60J 7/0076
USPC ..... 220/203, 704, 705, 706, 707, 708, 709, 220/710
See application file for complete search history.

(56) References Cited

U.S. PATENT DOCUMENTS 3,025,004 A 3/1962 Levi
3,615,595 A 10/1971 Guttag
3,776,458 A 12/1973 Chunga, Sr.
4,109,817 A * 8/1978 Payne ..... B65D 77/283 220/706
4,340,175 A 7/1982 Danek et al.
4,850,533 A 7/1989 Hoshi et al.
4,930,652 A * 6/1990 Murphy ..... B65D 77/283 215/388
5,094,861 A 3/1992 D'Auguste et al.
5,172,827 A * 12/1992 Chang ..... B65D 77/283 220/707
5,201,460 A 4/1993 Caines
5,482,202 A * 1/1996 Wen ..... B65D 77/283 220/705
D371,269 S 7/1996 Shattuck et al.
5,727,734 A * 3/1998 Su ..... A47G 21/189 215/388
D408,886 S 4/1999 Matyushin et al.
6,283,294 B1 9/2001 Thorball et al.
6,460,777 B2 10/2002 Float et al.
6,676,032 B2 1/2004 Banach
D487,375 S 3/2004 Bengtsson et al.
7,093,868 B1 8/2006 Shen
D575,570 S 8/2008 Antonelli
D602,726 S 10/2009 Baron
D614,346 S 4/2010 Lik
7,753,284 B1 7/2010 Raitses
7,823,802 B1 11/2010 Roche et al.
D674,649 S 1/2013 Ludwig et al.
8,459,484 B2 * 6/2013 Ravelo ..... B65D 77/283 215/388
8,579,148 B2 * 11/2013 Slansky ..... A47G 21/18 220/707
D719,388 S 12/2014 Ecseri
8,904,820 B2 12/2014 Chen
D726,477 S 4/2015 Buck
D728,154 S 4/2015 Lavanchy et al.
D749,884 S 2/2016 Martins
D755,440 S 5/2016 Collen
D757,476 S 5/2016 O'Neill
D762,408 S 8/2016 Palazzi
D772,632 S 11/2016 Buck
D778,492 S 2/2017 Liu
D798,095 S 9/2017 Palazzi
D808,580 S 1/2018 Kwitel et al.
D812,807 S 3/2018 Thuery
D813,445 S 3/2018 Scott
D815,479 S 4/2018 Scardino et al.
D819,264 S 5/2018 Mykhaylovych
D825,837 S 8/2018 Abroff et al.
D825,838 S 8/2018 Abroff et al.
D827,920 S 9/2018 Fornarelli
D828,623 S 9/2018 Fornarelli
D831,397 S 10/2018 Diorio et al.
10,092,713 B2 10/2018 Terry et al.
10,123,641 B1 11/2018 Pepper
10,136,672 B2 11/2018 Minskoff et al.
10,159,278 B2 12/2018 Minskoff et al.
10,159,369 B2 12/2018 MacDonald
D841,231 S 2/2019 Hawes et al.
D844,221 S 3/2019 Tucker et al.
D846,327 S 4/2019 Peterson
D847,568 S 5/2019 Hartnett
D853,164 S 7/2019 Pepper
D866,235 S 11/2019 Pepper
2002/0030059 A1 * 3/2002 Hirota ..... B65D 77/283 220/704
2002/0030115 A1 3/2002 Float et al.
2002/0088870 A1 7/2002 Banach
2004/0098807 A1 * 5/2004 Ham ..... A47C 27/081 5/655.3
2006/0037961 A1 * 2/2006 Suissa ..... B65D 77/283 220/705
2006/0060556 A1 * 3/2006 Lee ..... B65D 51/246 215/388
2006/0254604 A1 11/2006 Martinez Fernandez
2007/0181589 A1 * 8/2007 Lipson ..... A47G 19/2227 220/713
2008/0169356 A1 * 7/2008 Trejo ..... A47G 19/2266 239/33
2008/0223818 A1 * 9/2008 Shafik ..... A47G 19/2222 215/388
2009/0283608 A1 11/2009 Crawley
2011/0057050 A1 * 3/2011 Shakur-Jenkins ... A47G 21/182 239/33
2012/0012597 A1 * 1/2012 Rossitto ..... A47G 21/18 220/705
2012/0068487 A1 3/2012 Wong
2012/0138622 A1 6/2012 Slansky
2013/0270357 A1 10/2013 Anderson
2014/0013880 A1 1/2014 Nikolaizig
2014/0231535 A1 8/2014 Alotaibi
2014/0246445 A1 9/2014 Lee et al.
2014/0339325 A1 11/2014 Williams et al.
2014/0339819 A1 11/2014 Baker
2015/0190004 A1 7/2015 Chang et al.
2015/0313390 A1 * 11/2015 Russo ..... A47G 19/2272 220/212
2016/0051071 A1 2/2016 Buck
2016/0338406 A1 11/2016 Liu
2017/0150754 A1 6/2017 Lin
2018/0235390 A1 8/2018 Lehmann
2019/0059624 A1 2/2019 Kazmierczak, III et al.
2019/0069701 A1 3/2019 O'Neill
2019/0082815 A1 3/2019 Chen
2019/0099025 A1 4/2019 Rieger

FOREIGN PATENT DOCUMENTS

KR 20090098400 A 9/2009
KR 20090108259 A 10/2009
KR 20100128648 A 12/2010
KR 20130091922 A 8/2013

OTHER PUBLICATIONS

U.S. Appl. No. 16/186,560, filed Nov. 11, 2018, Pepper, Miles.
U.S. Appl. No. 29/648,754, filed May 23, 2018, Pepper, Miles.
U.S. Appl. No. 29/654,245, filed Jun. 2018, Pepper, Miles.
U.S. Appl. No. 29/661,212, filed Aug. 2018, Pepper, Miles.
U.S. Appl. No. 29/664,367, filed Sep. 2018, Pepper, Miles.
U.S. Appl. No. 29/665,794, filed Oct. 2018, Pepper, Miles.
U.S. Appl. No. 29/701,902, filed Aug. 15, 2019, Pepper, Miles.
Alibaba.com, Everich collapsible stainless steel straw, Publication date unknown, [site visited May 7, 2019], Available on the Internet URL https://www.alibaba.conn/product-detail/collapsible-stainless-

(56) References Cited

OTHER PUBLICATIONS stee1-304-silicone-straw 62016062697.htnnl?spnn=a2700.galleryofferlist.nornnalList.124.6e7cf7eawdAolW (Year: 2019).
Amazon.com, Collapsible straw Divine Domicile, Publication date Mar. 2019, [site visited Mar. 6, 2019], Available on the Internet URL https://www.annazon.conn/collapsible-straw-Divine-Domicile-stainless/dp/B07R1Y8JD2/ref=sr_1_fkmrnull_1?keywords=straw%2Bdivine%2Bdonnicile&gid=1557249520&s=gat (Year: 2019).
Amazon.com, FinalStraw—Original—Patented—Real Simple, Shark Tank, Kickstarter, Publication date Mar. 2019, [site visited May 7, 2019], Available on the Internet URL https://www.annazon.conn/dp/B07KRRGPV4/ref=psdc_16439911_t1_BO7KT8XBSS (Year: 2019).
Amazon.com, Hydreann straw1 Collapsible Reusable Stainless Steel, Publication date Aug. 20, 2018, [site visited Jan. 29, 2019], Available on the Internet URL https://www.annazon.conn/Hydreann-Collapsible-Reusable-Stainless-Food-Grade/dp/B07GNZKKDK/_ref=cnn_cr_arp_d_producttop?ie=UTF8.
FinalStraw.com, FinalStraw, Earliest publication date Aug. 2018 from Internet Archive, [site visited May 7, 2019], Available on the Internet URL https://web.archive.org/web/20180803173948/https://finalstraw.conn/ (Year: 2019).
Walmart.com, Collapsible Reusable Straws with Case Holder, Publication date unknown, [site visited Jan. 29, 2019], Available on the Internet URL https://www.walmart.com/ip/_Collapsible-Reusable-Straws-Case-Holder-Keychain-Portable-Collapsible-Foldable-Stainless-Steel-Snnoothie-Drinking-Metal-Tunnb_ler-Straws-Cleaning-Brus.
Complaint, United States International Trade Commission, Investigation No. 337-TA-1183, filed Oct. 8, 2019.

* cited by examiner

REUSABLE FOLDABLE DRINKING STRAW IN STORAGE CASE

This is is a Continuation of U.S. application Ser. No. 16/186,560, filed Nov. 11, 2018, which is a continuation of U.S. application Ser. No. 15/987,681 filed May 23, 2018, and claims the benefit of Provisional Application Nos. 62/579,013 filed Oct. 30, 2017 and 62/658,976 filed Apr. 17, 2018. The entire contents of each of the foregoing being incorporated by reference herein.

BACKGROUND

Over 500,000,000 plastic straws are used each day in the United States and are then disposed of after a single use. In only the past twenty years, people have come to expect plastic straws in every drink, in an example of extreme waste being generated for convenience. These short-lived tools are usually dropped into a garbage can with no further thought, instantly becoming a source of plastic pollution. (http://www.plasticpollutioncoalition.org/no-straw-please/)

The consumption of 500 million single-use plastic straws a day is enough straws to wrap around the circumference of the earth 2.5 times per day. Currently, it is nearly impossible to recycle plastic straws, which often end up in a dump. Plastic straws are also swept away by winds and end up in waterways, and eventually into the oceans. Plastic straws are confused as food by fish and seabirds. In a recent study, it was estimated that approximately 60% of seabirds currently have plastic in their stomachs, and by 2050, 99% percent of seabirds will have plastic in their stomachs.

In effort to combat this massive environmental problem, single-use plastic straws are being banned in restaurants, cafes and bars all around the world. For example, the city of Seattle, Wash. has banned all plastic straws as of Jan. 1, 2018. Other countries, states, and cities are in the process of implementing similar bans of single-use plastic straws. Despite governmental efforts and increased public awareness of the environmental problems caused by single-use plastic straws, plastic straws are still being served in many places.

One solution to not using plastic straws is for people to carry their own, reusable straws. But the problem is that reusable straws are often made out of glass or metal, and by nature are long and inconvenient to carry around. Glass straws are easy to break and need a bulky case to keep them from snapping. If people are to bring reusable straws everywhere, they will want somewhere clean to put the reusable straw. That means keeping the reusable straw in a case that's even bigger and bulkier than the glass and metal straws in their current form.

Therefore, there exists a need for a convenient reusable drinking straw that is easy to carry, store, and easy to clean.

SUMMARY

The present invention is directed to a reusable drinking straw that is foldable into a compact configuration for storage and easily transportable in a storage case. The straw comprises a rigid external tube and a flexible internal tubing that is foldable to a compact configuration for storage. In a folded configuration, the reusable straw preferably has a significantly reduced length of approximately one-half to one-fourth of its extended length when in use. The external tube of the straw is preferably formed of multiple rigid segments for supporting the flexible internal tubing in the extended configuration during use as a drinking straw. The rigid segments preferably are separable from one another and slideable along the flexible internal tubing. Preferably, the rigid segments are configured to be at least in part in the shape of a portion of a cylinder or tube to at least partially surround a portion of the flexible tube. A simple cleaning device is provided to clean the straw after use. A storage case is provided to store the straw in the folded configuration in a compact form and to store the cleaning device.

In a preferred embodiment, the reusable drinking straw foldable for storage has a rigid external tube formed of a plurality of tubular segments. The external tube has a proximal end, an opposite distal end, a hollow interior and a central longitudinal axis passing through its ends. The hollow interior being accessible through the ends and having an interior diameter. Each of the tubular segments is configured to be coupled to at least another one of the tubular segments when positioned adjacent to one another along the central longitudinal axis of the external tube to form the external tube.

A flexible internal tubing is positioned within the external tube. The flexible internal tubing having a proximal end, an opposite distal end, and a passageway accessible through its ends. The internal tubing being formed of an elastic material for conducting liquid through the passageway and being impermeable to liquids. The internal tubing being positioned within the external tube with the proximal and distal ends of the internal tubing proximate to the proximal and distal ends, respectively, of the external tube to conduct liquid therethrough.

The drinking straw is in an extended configuration preferably when at least two of the tubular segments are coupled together to form the rigid external tube with the flexible internal tubing therethrough. The internal tubing being under tension within the external tube to maintain the tubular segments coupled together. The elastic nature of internal tubing, returning from a stretched state in the folded configuration to a less-stretched state in the extended configuration, functions to essentially automatically extend and reconfigure the drinking straw to the extended configuration.

The drinking straw is in a folded configuration preferably when at least two of the tubular segments are uncoupled from one another and moved apart along the flexible internal tubing by stretching the internal tubing and folding the internal tubing between at least two tubular segments.

A cleaning element is provided that is configured to clean the passageway of the flexible internal tubing of the drinking straw. The cleaning element preferably includes a squeegee sized and configured to pass through said passageway of the flexible internal tubing and a cable coupled to the squeegee to pull the squeegee through the drinking straw.

A storage case is provided that is configured to contain the drinking straw and store the cleaning element. The storage case contains the drinking straw in the folded configuration. The storage case also stores the cleaning element. In a preferred embodiment, the storage case includes a first area for storing said drinking straw and second area for storing said cleaning element.

The present invention provides a convenient reusable drinking straw that is easy to carry, store, and easy to clean.

These and other objects of the present invention will be apparent from review of the following specification and the accompanying drawings.

BRIEF DESCRIPTION OF THE DRAWINGS

The accompanying drawings, which are included to provide further understanding of the present invention disclosed in the present disclosure and are incorporated in and constitute a part of this specification, illustrate aspects of the present invention and together with the description serve to explain the principles of the present invention. In the drawings.

DETAILED DESCRIPTION

The detailed description set forth below is intended as a description of various configurations of the present invention and is not intended to represent the only configurations in which the present invention may be practiced. It will be apparent, however, to those of ordinary skill in the art that the present invention is not limited to the specific details set forth herein and may be practiced without these specific details.

Figure 1:
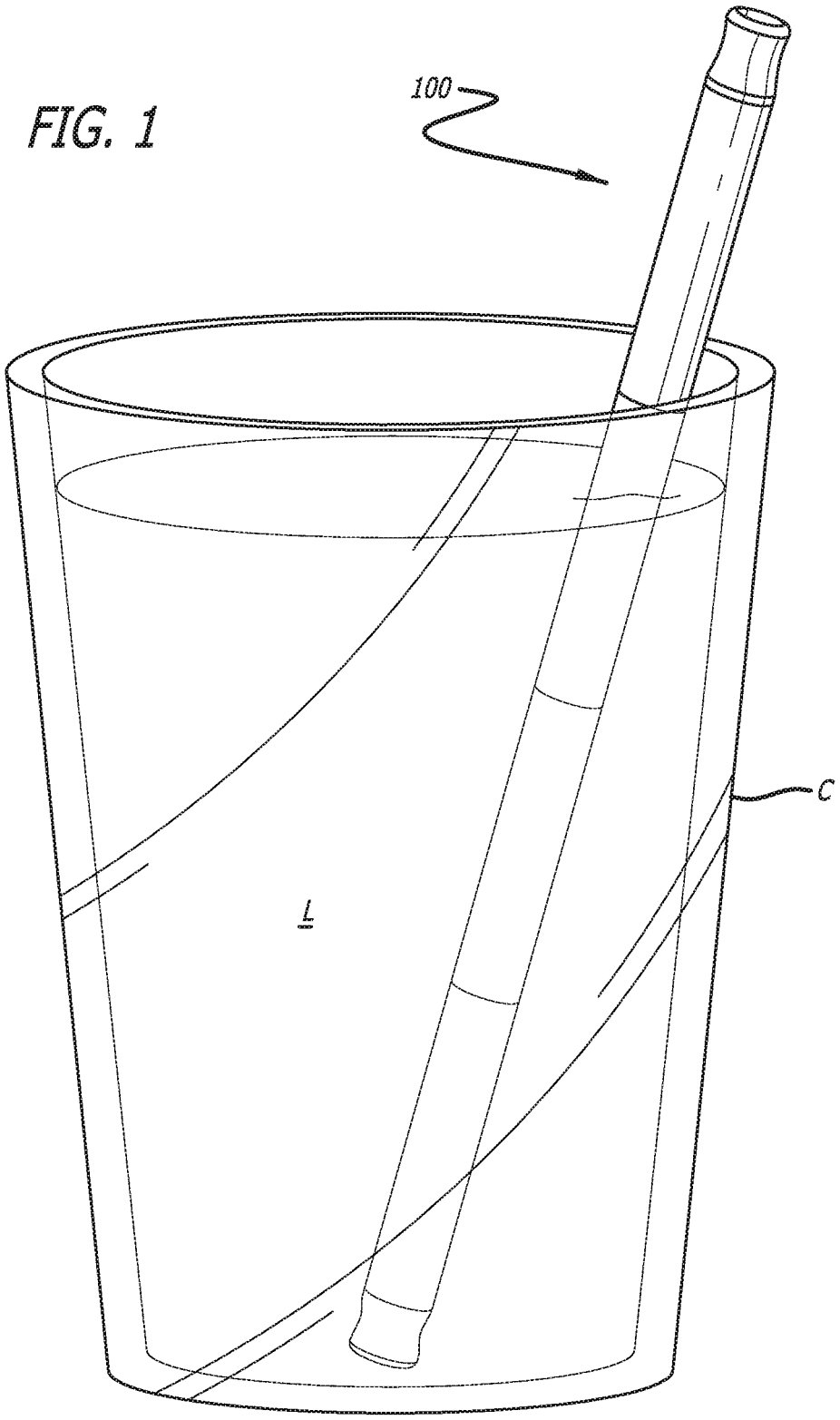
FIG. 1 is a side elevation view of an embodiment of a straw of the present invention in an extended configuration shown in a drinking glass.

Referring to FIG. 1, a reusable drinking straw 100 that is foldable for storage in accordance with the present invention is shown. Straw 100 is used to drink a liquid L from a container C. Liquid L can be at ambient temperature or hotter or colder than ambient temperature. For example, liquid L can vary in viscosity and density from water to thicker liquids such as juices, smoothies, shakes, and bubble teas such as Boba for example, and may be at least partially frozen. Liquid L may also be a mixture with other ingredients suspended therein suitable for drinking through a drinking straw.

As shown in FIGS. 2A-4, in a preferred embodiment, straw 100 includes a rigid external tube 102 formed of a plurality of tubular segments 104. Tubular segments 104 are preferably sufficiently rigid to form an outer "shell" in the form of external tube 102 for straw 100. External tube 102 has a proximal end 106, an opposite distal end 108, a hollow interior 110 and a central longitudinal axis (CLA) passing through ends 106 and 108. Hollow interior 110 is in communication with and accessible through ends 106 and 108. Hollow interior 110 has an interior diameter 112. Each of tubular segments 104 is configured to be coupled to at least another one of tubular segments 104 when positioned adjacent to one another along the central longitudinal axis (CLA) to form external tube 102.

Straw 100 preferably includes a flexible internal tubing 200 positioned within hollow interior 110 of external tube 102. Internal tubing 200 preferably has a proximal end 202, an opposite distal end 204, and a passageway 206 in communication with and passing through ends 202, 204 of internal tubing 200. In a preferred embodiment, internal tubing 200 is formed of an elastic material suitable for drinking and conducting liquid through passageway 206 and is impermeable to liquids to prevent leakage along its length. It is preferred that internal tubing 200 be sufficiently elastic and flexible to be stretchable along the central longitudinal axis (CLA) of straw 100 to maintain tubular segments 104 under tension and be further stretchable to allow separation of tubular segments 104 and folding of internal tubing 200 between two separated tubular segments 104. Preferably, internal tubing 200 is formed of materials including as examples at least one of plastics, non-recycled plastics, thermoplastic elastomers (TPE), thermoplastic polyurethane (TPU), silicones, natural rubbers including latex, plant-based plastics, and other recyclable and renewable materials.

Internal tubing 200 has an outer diameter 208 and an inner diameter 210. Outer diameter 208 being less than inner diameter 114 of external tube 102. Internal tubing 200 is positioned within external tube 102 with proximal end 202 and distal end 204 of internal tubing 200 proximate to proximal end 106 and distal end 108, respectively, of external tube 102 to conduct liquid therethrough. In a preferred embodiment, internal tubing 200 is positioned under tension within hollow interior 110 of external tube 102 and holds tubular segments 104 together and straw 100 in the extended configuration. Although tubular segments 104 are shown as cylindrical, it is appreciated that tubular segments can be configured to at least partially surround a portion of internal tubing 200. Internal tubing 200 allows for liquid to pass through it, while being the elastic force needed to pull tubular segments 104 together, forming straw 100 into a rigid, extended configuration to allow for drinking therethrough. When straw 100 (in a folded state) is taken out of its storage case the flexible nature of the elastic internal tubing 200 will spring straw 100 back into its extended form, thus snapping out and "self-assembling" straw 100 to an extended configuration.

Figure 5:
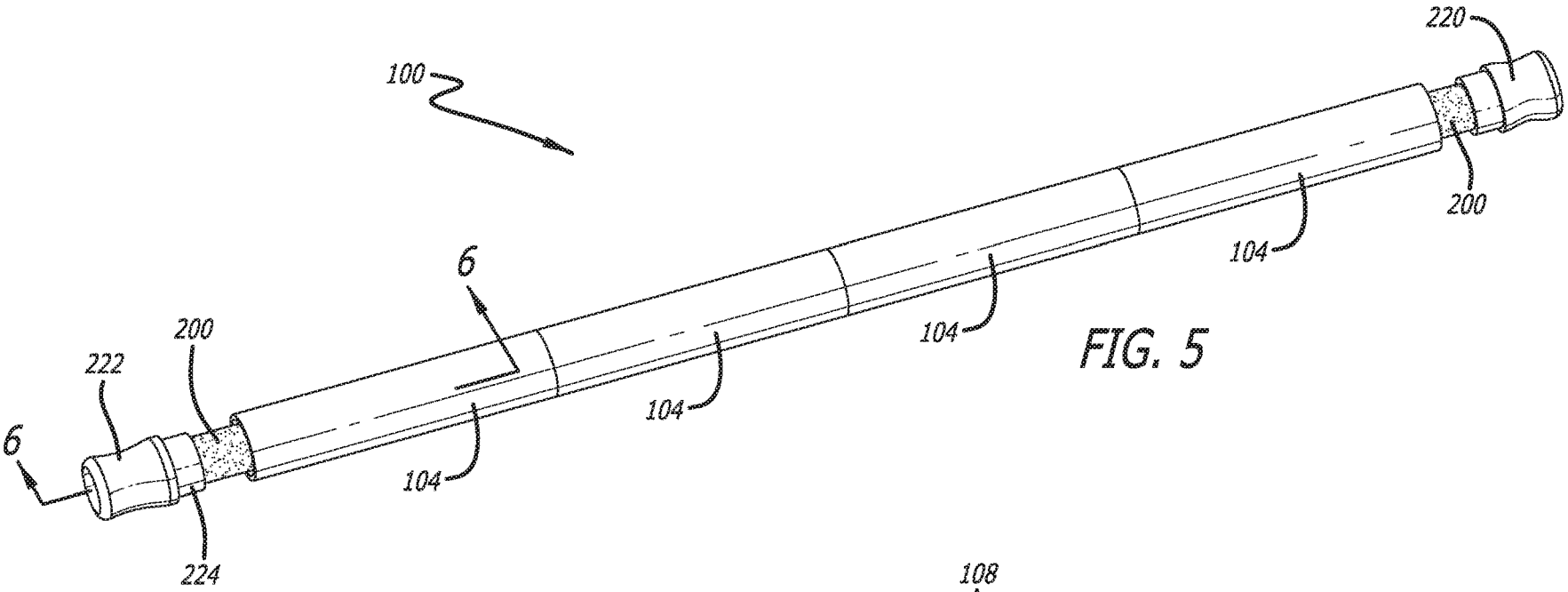
FIG. 5 is a perspective side view of the straw of FIG. 1 with the internal tubing shown partial extending therefrom.
Figure 6:
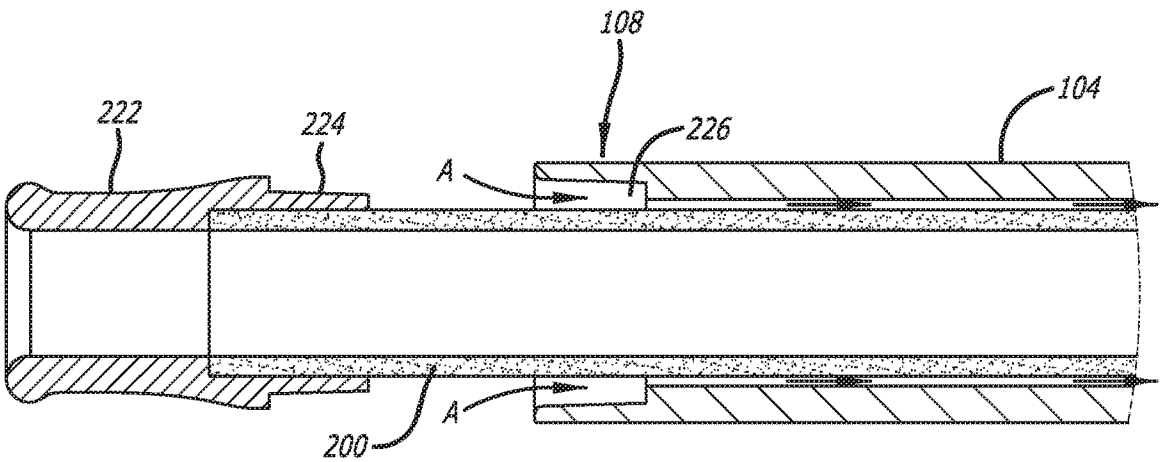
FIG. 6 is an enlarged cross sectional view along lines 6-6 of FIG. 5.

As best shown in FIGS. 3-6, in a preferred embodiment, straw 100 further includes a first tip 220 at distal end 108 and a second tip 222 proximal end 106 of external tube 102. Tips 220 and 222 can be coupled to internal tubing 200 and are configured to interdigitate with proximal end 106 and distal end 108, respectively, of external tube 102. Each of tips 220 and 222 has a reduced portion 224 for positioning into an enlarged diameter portion 226 of tubular segment 104. Enlarged diameter portion 226 has a larger diameter than inner diameter 112 of hollow interior 110 and a larger diameter than outer diameter 208 of internal tubing 200. When inserted into respective ends 106 and 108, reduced portion 224 of tips 220 and 222 fits into enlarged diameter portion 226 between internal tubing 200 and external tube 102 as shown in FIG. 6. The elastic quality of internal tubing 200 keeps tips 220 and 222 in place with ends 106 and 108 of external tube 102.

Straw 100 can be configured from an extended configuration to a folded configuration. Straw 100 is in an extended configuration when at least two of tubular segments 104 are coupled together to form rigid external tube 102 with flexible internal tubing 200 therethrough. Internal tubing 200 being under tension within external tube 102 to maintain tubular segments 104 coupled together.

Straw 100 is in a folded configuration (FIG. 7) when at least two of tubular segments 104 are uncoupled and moved apart along central longitudinal axis (CLA) of internal tubing 200 by stretching internal tubing 200, tubular segments 104 are in a generally parallel position, and internal tubing 200 is folded at least in-part between at least two tubular segments 104.

In the extended configuration, tubular segments 104 preferably are positioned coaxial to one another along the central longitudinal axis (CLA) and in the folded configuration tubular segments 104 preferably are positioned generally parallel to one another.

Figure 2A:
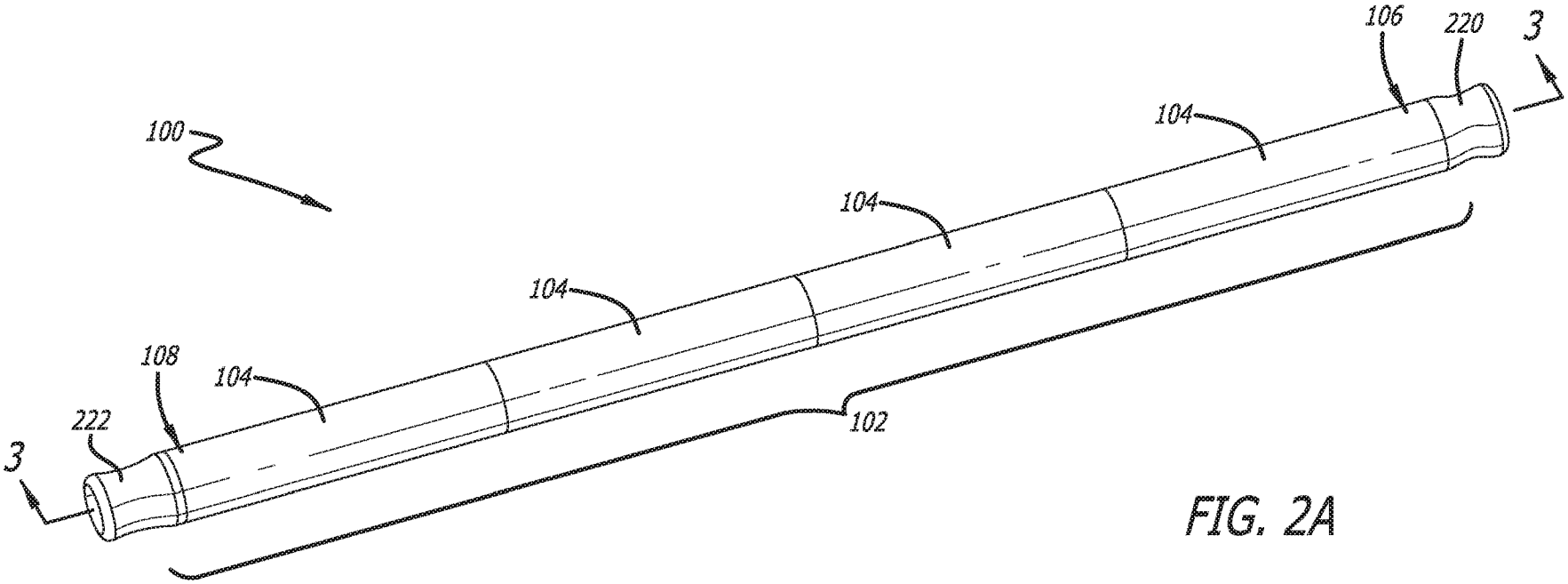
FIG. 2A is a perspective side view of the straw of FIG. 1.
Figure 2B:
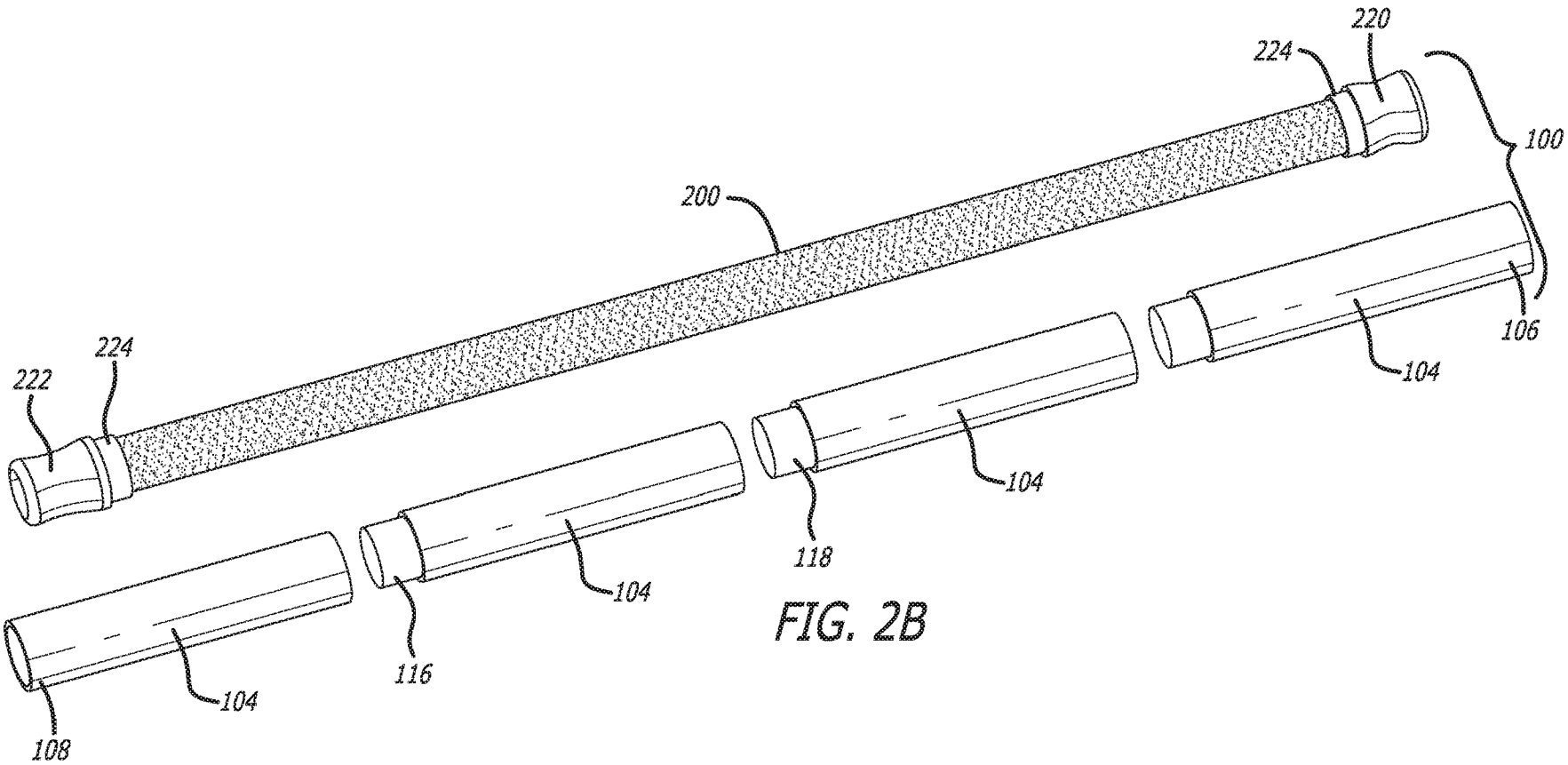
FIG. 2B is an exploded perspective side view of the straw of FIG. 1.
Figure 3:
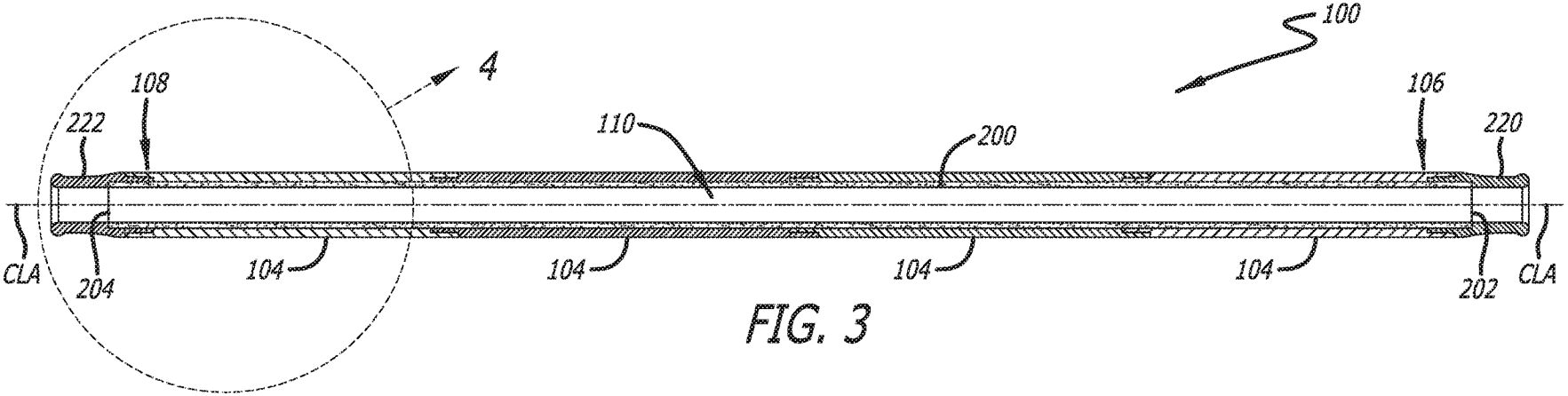
FIG. 3 is a cross sectional view along line 3-3 of FIG. 2A.
Figure 4:
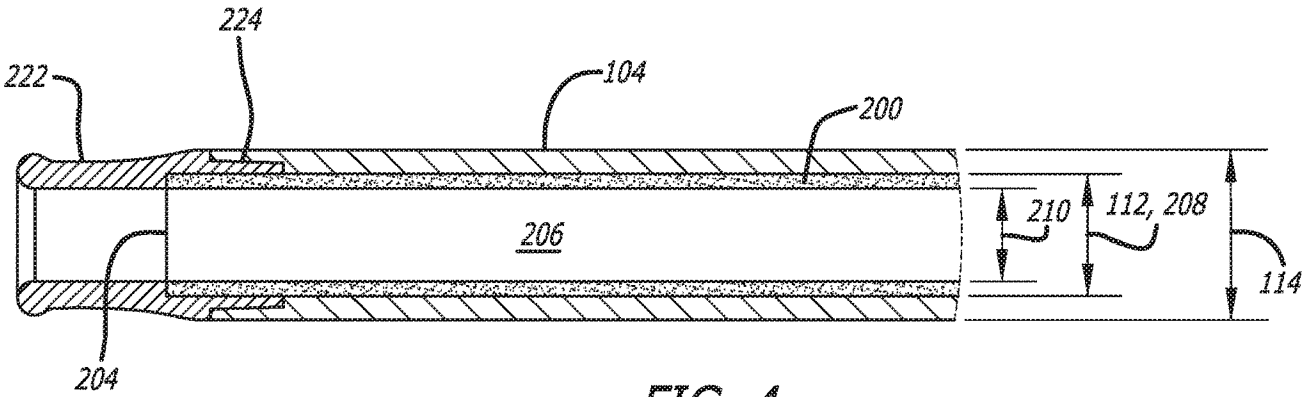
FIG. 4 is an enlarged isolation view along broken lines 4 of FIG. 3.

As shown in FIG. 2B, in preferred embodiments of straw 100, at least one of tubular segments 104 includes a male end 116 and a female end 118. It is appreciated that the ends of tubular segments 104 are not limited to a male or female configuration and can be otherwise configured. Specifically, it is contemplated that the free ends of tubular segments 104 at opposite ends of straw 100 can be configured to be in the shape of or to couple to an end tip suitable for use in drinking. Preferably, at least one of tubular segments 104 has an inner diameter that is the same at both of its ends. Preferably, at least one of tubular segments 104 has an inner diameter that is different at each of its ends. Preferably, at least one of tubular segments 104 has an outer diameter that is the same at both of its ends, Preferably, at least one of tubular segments 104 has an outer diameter that is different at each of its ends.

Preferably, at least one of tubular segments 104 has an inner diameter of approximately 7 mm and can be in the range of 2 mm to 30 mm, with an inner diameter as measured at the female connection of approximately 8 mm and an inner diameter as measured at the male connection of approximately 7 mm; at least one of tubular segments 104 has a maximum outer diameter of approximately 9 mm and can be in the range of 3 mm to 35 mm; and at least one of tubular segments 104 has length of approximately 5 cm and can be in the range of 2.5 cm to 16.5 cm. It is appreciated that tubular members 104 can have a variety of dimensions and configurations suitable for the intended purpose. The measurements and ranges provided herein are intended to be exemplary.

The inner diameters and outer diameters of straw 100 can range anywhere from small to large, so that straw 100 can be used as a straw/stirrer for cocktails, straws for drinks, and as a "Boba" straw, used to consume Boba tea. Boba tea contains tapioca balls that range in diameter, but typically are around ⅛" in (3.175 mm) diameter. Some Boba tea balls are smaller and larger than this, and straw 100 can be sized and shaped to accommodate any of these sizes. It is understood that the inner diameter and outer diameter of straw 100 can vary in order to accommodate any drink.

Tubular segments 104 can have a circular cross section, an oval cross section, a triangular cross section, or a rectangular cross section transverse to the central longitudinal axis (CLA) of external tube 102. Similarly, internal tubing 200 can have a circular cross section, an oval cross section, a triangular cross section, or a rectangular cross section transverse to the central longitudinal axis (CLA) of external tube 102 and can, but need not, correspond to the transverse cross sectional shape of tubular segment 104. Tubular segments 104 are preferably formed of materials including at least one of stainless steel, titanium, other metals, carbon fiber, composite materials, wood, non-recycled plastics, plant-based plastics, and other recyclable and renewable materials. Stainless steel is a preferred material as it is biocompatible, does not rust, recyclable, strong, upcycled stainless steel, ability to be laser engraved in black. Titanium is also biocompatible, does not rust, recyclable, highly strong/weight ratio, upcycled titanium supplier, super strong, ability to have laser engraving in color. The metal tubular segments 104 can be laser engraved with logos, designs and artwork. Alternatively, any sufficiently rigid material suitable for its intended purpose may be used including plastics and composite materials to form tubular segments 104. Tubular segments can also be thermo-insulated to reduce heat transfer to a user when straw 100 is used with a hot liquid like a hot coffee drink for example.

As shown in FIGS. 1-7, in a preferred embodiment straw 100 has at least four tubular segments 104. However, it is appreciated that straw 100 can have anywhere from two segments to 10 segments or more depending on the length of the straw desired. Such a range of configurations of straw 100 will work for short cocktail glasses that only need straws to be approximately 2 to 4 inches long, as well as much longer straws to be used in tall glasses and other drink containers, having a length of up to approximately 2 feet for example. Straw 100 can have a length suitable for the intended purpose of drinking liquids out of containers of various shapes and sizes including oversized drinks such as a "half yard glass" as an example.

In a preferred embodiment, tubular segments 104 are preferably approximately 5 cm long and a maximum outer diameter of approximately 9 mm and interlock into each other. In this preferred embodiment, tubular segments 104 preferably have ends in the form of a male connection 116 and a female connection 118, or a combination thereof. Female connection preferably has a larger inner diameter and terminates at an internal shoulder at the junction of a smaller inner diameter of tubular segment. Male connection has a smaller outer diameter than the inner diameter of female connection and consequently also has a smaller inner diameter than the inner diameter of female connection. The inner diameter can be same as the remainder of the tubular segment. The corresponding male and female connections, 116, 118 of respective tubular segments interlock with each other, forming a sturdy straw 100 once assembled. For example, individual tubular segments 104 can snap together easily by applying pressure to either side, similar to a pen cap snapping onto the pen. Such a mechanism also locks tubular segments 104 in place, to prevent individual rotation of tubular segments 104 around internal tubing 200. As another example, tubular segments 104 can include a metal ridge that "clicks" into a channel of a female connection of next tubular segment 104. Straw 100 preferably assembles and folds into fourths.

It is appreciated that straw 100 can have a variety of shapes and sizes suitable for its intended purpose, while still retaining the initial concept of a reusable drinking straw that folds up and fits into a compact carrying case.

Preferably, for a straw 100 having an external length of approximately 23 cm, internal tubing 200 has an un-stretched length of approximately 14 cm, for example. The length of the internal tubing varies depending on the length of straw 100 and the elasticity of the material(s) of the internal tubing. Generally, the un-stretched length of internal tubing is less than the maximum external length of the straw itself in the extended configuration. In a preferred embodiment, internal tubing 200 has an inner diameter that approximately 5.0 mm and can be in the range of 2 mm to 29 mm for example; an outer diameter that is approximately 7.1 mm: and internal tubing 200 has a wall thickness of approximately 1.2 mm and can be in the range of 0.5 mm to 5 mm. It is appreciated that wall thickness, inner diameter, and outer diameter of internal tubing 200 can have a variety of dimensions and configurations suitable for the intended purpose and vary depending on the size and configuration of the straw. The measurements and ranges provided herein are intended to be exemplary. Preferably, the outer diameter of the internal tubing is less than or up to the inner diameter of the tubular segments in which the internal tubing inserted. It is appreciated that tubular members 104 can have a variety of dimensions and configurations suitable for the intended purpose.

Internal tubing 200 preferably is made of food grade silicone. FDA certified food grade silicone provides the advantages of being food safe, heat safe, soft, hydrophobic, temperature resistant, −76 to 500 degrees Fahrenheit, dishwasher safe, lots of colors, inexpensive, flexible, feels better than bare metal on teeth, easy to clean, no BPA, bacteria resistance, boiled to sterilize, durable, resists moisture, and instantly cools. Internal tubing can also include, be treated with, or formed at least in part of an antibacterial material or substance.

Figure 13:
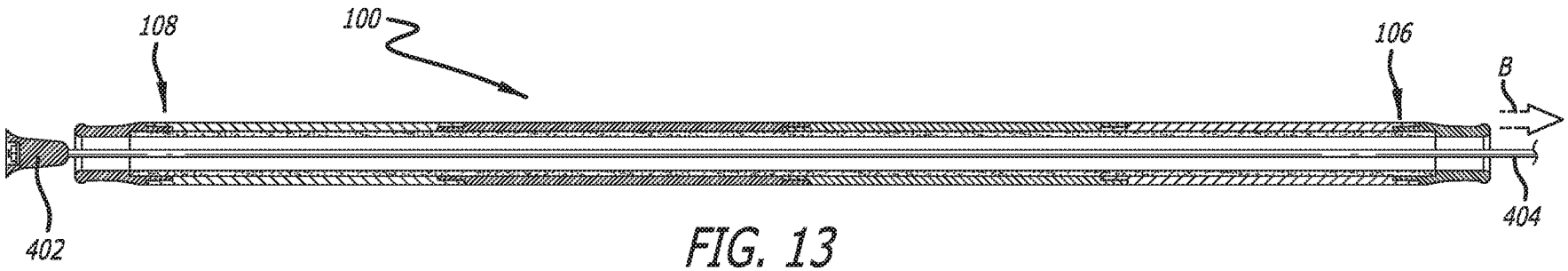
FIG. 13 is a cross sectional side view of the straw of FIG. 1 with a side elevational view of a cleaning element positioned therein.
Figure 14:
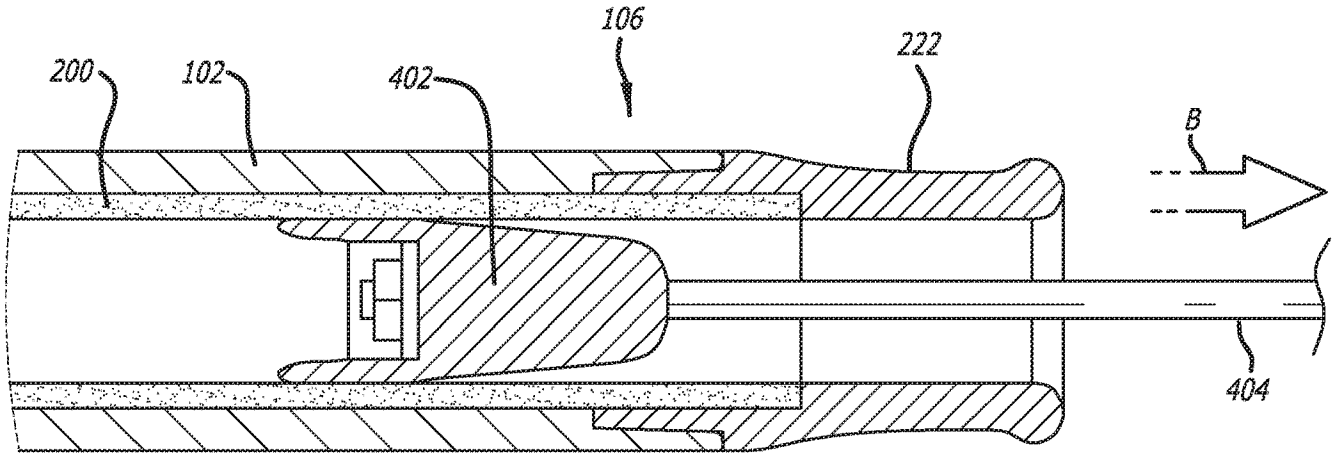
FIG. 14 is a partial, enlarged cross sectional view of FIG. 13, the cleaning element shown in partial cross section positioned therein.

Referring to FIGS. 13 and 14, a cleaning element 400 for cleaning passageway 206 of flexible tubing 200 is shown. In a preferred embodiment, cleaning element 400 includes a squeegee 402 sized and configured to pass through passageway 206 of internal tubing 200 and a cable 404 coupled to squeegee 402. Straw 100 is shown being used with cleaning element 400. Cable 402 is fed through one of ends 106, 108 and through passageway 206 of internal tubing 200 and extends out of the opposite end of internal tubing 200. Cable 402 is pulled (in the direction of arrow B as shown in FIG. 14) by the user to pull squeegee 402 through passageway 206 of internal tubing 200 to clear any debris and fluid that may be present therein.

In a preferred embodiment, squeegee 402 is formed from injected food grade silicone with molded squeegee 402 formed around thin cable 404. Cleaning element 400 functions by inserting the end of cable 404 into the straw 100 and pulling on the end of cable 404 to pull squeegee 402 through the straw. Squeegee preferably has a "bullet shape" with rings on it, attached to the end of cable 404. Cleaning element 400 provides the benefits of cleaning straw 100 and is an incredibly small compact cleaning system. Since it fits into the same case, it is carried together with the straw.

Alternatively, the cleaning element can include a cleaning brush or squeegee with an enclosed magnet. An accompanying magnet is in the case. Using the magnetic forces of the two magnets, the cleaning brush or squeegee can be pulled through straw 100.

Figure 7:
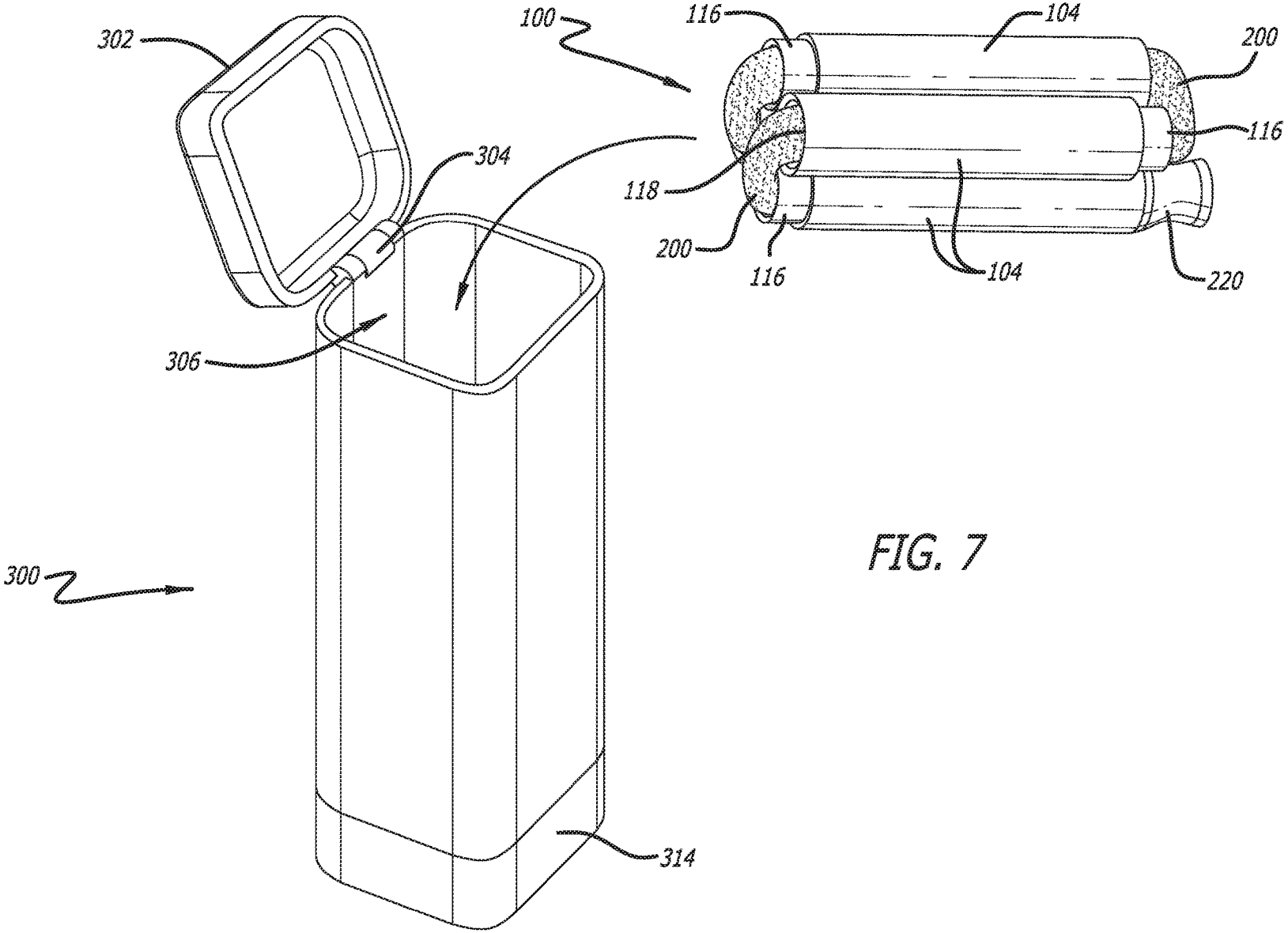
FIG. 7 is a perspective side view of the straw of FIG. 1 in a folded configuration and a perspective side view of an embodiment of a storage case of the present invention.
Figure 8:
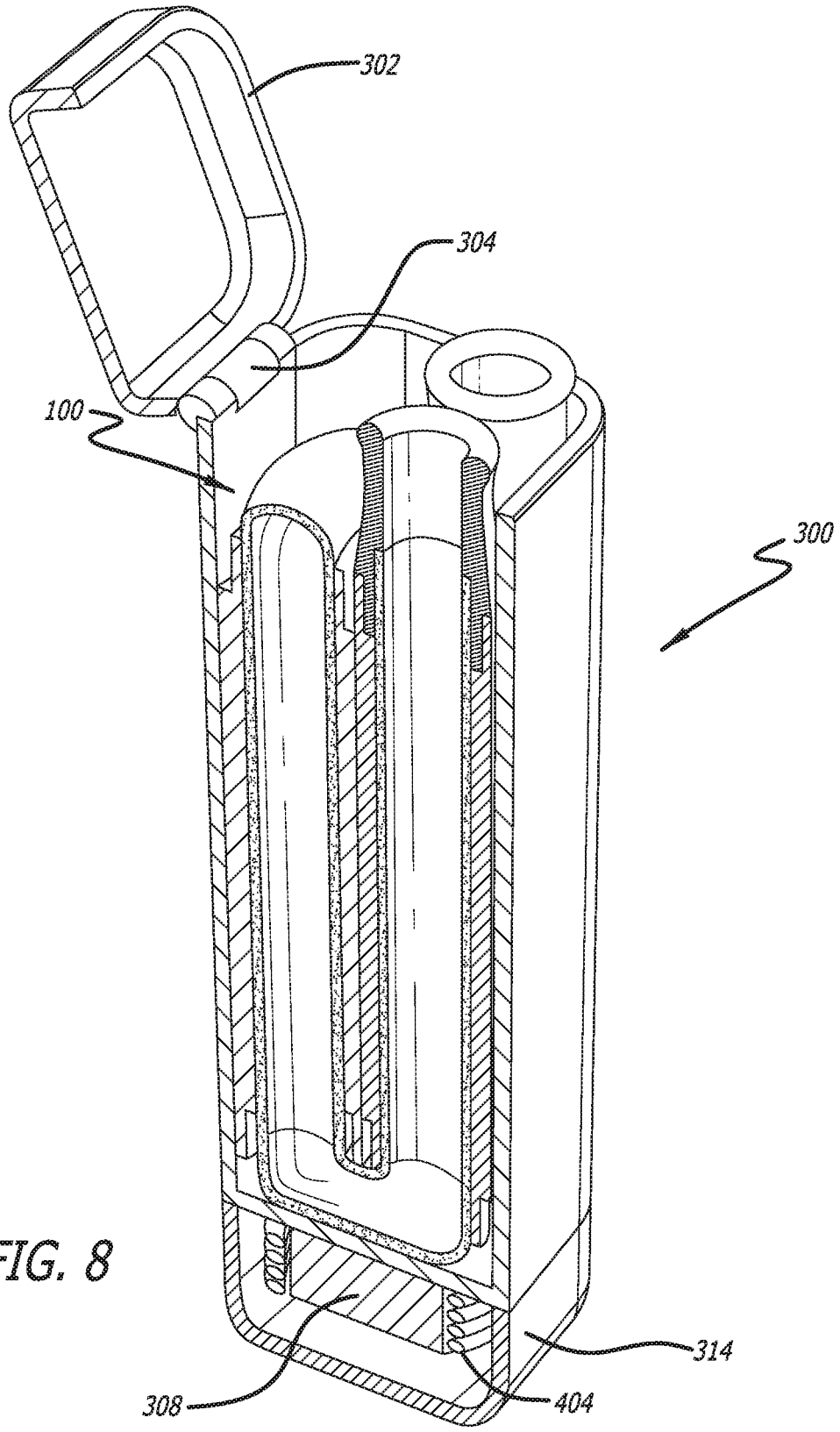
FIG. 8 is a perspective side view in cross section of the storage case and straw of FIG. 1, with the straw shown in a folded configuration inserted into the storage case.
Figure 9:
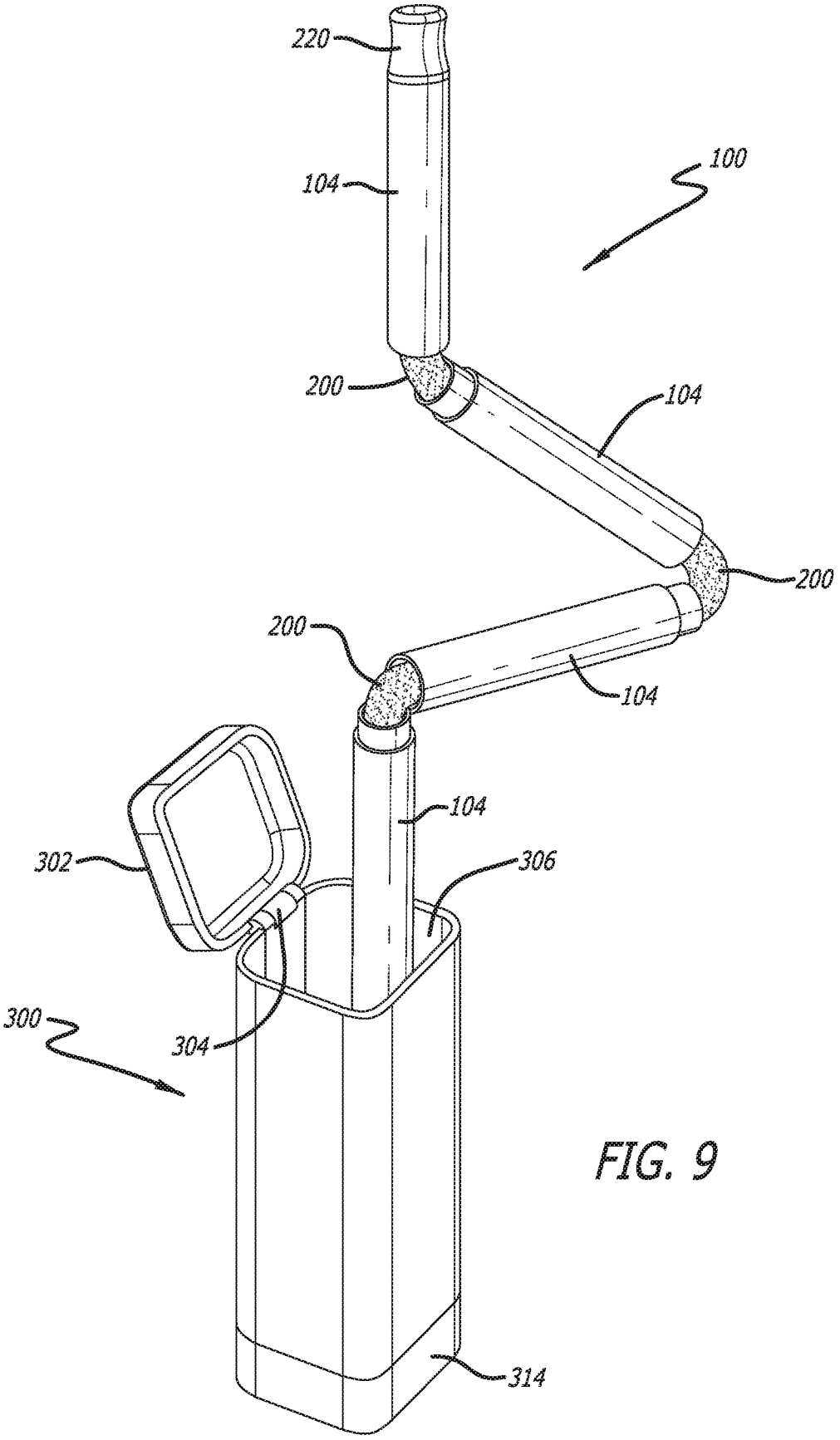
FIG. 9 is a perspective side view of the storage case and straw of FIG. 1, with the straw shown in a partially extended configuration being removed from the storage case.

Referring to FIGS. 7-9, straw 100 is shown in the folded configuration for insertion in a storage case 300. In the folded configuration, internal tubing 200 is exposed and folded between tubular segments 104 such that tubular segments 104 are stacked and positioned parallel to one another in a compact configuration. In the folded configuration, straw 100 fits within cavity 306 of storage case 300 and is held by storage case 300 in the folded configuration. Cavity 306 can be covered by lid 302 coupled by hinge 304 to storage case 300 to further protect straw 100 and stow it for ease of carrying.

As shown in FIG. 9, when straw 100 is removed from storage case 300, straw 100 returns to the extended configuration and straw 100 is ready for drinking liquid. The elastic nature of internal tubing 200, returning from a stretched state in the folded configuration to a less-stretched state in the extended configuration, functions to essentially automatically extend and reconfigure straw 100 to the extended configuration.

Figure 10:
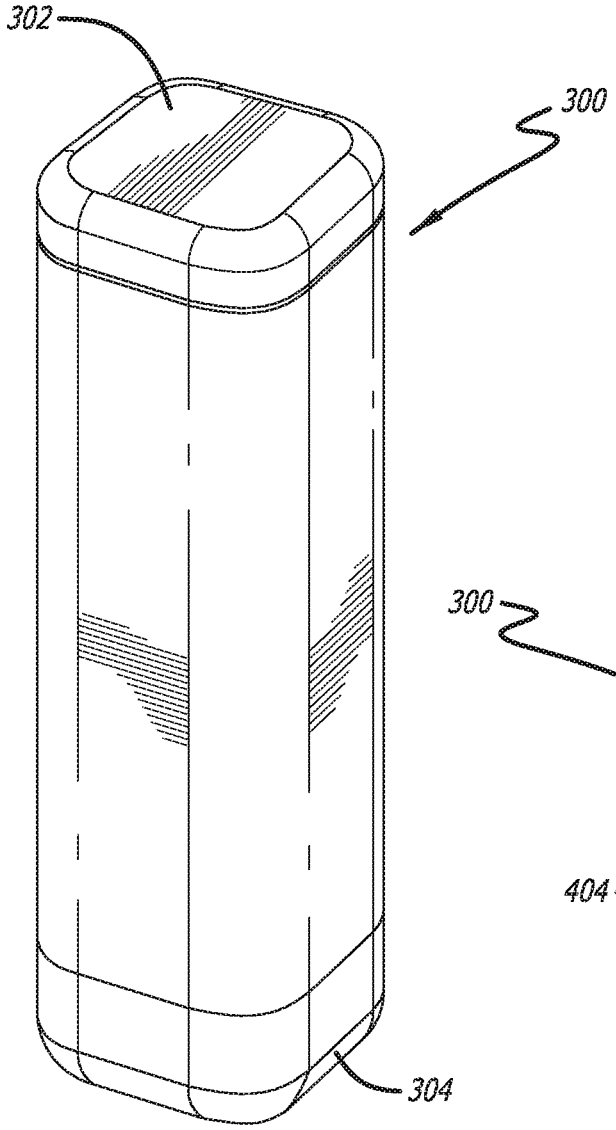
FIG. 10 is a perspective side view of the storage case of FIG. 8 in the closed position.
Figure 11:
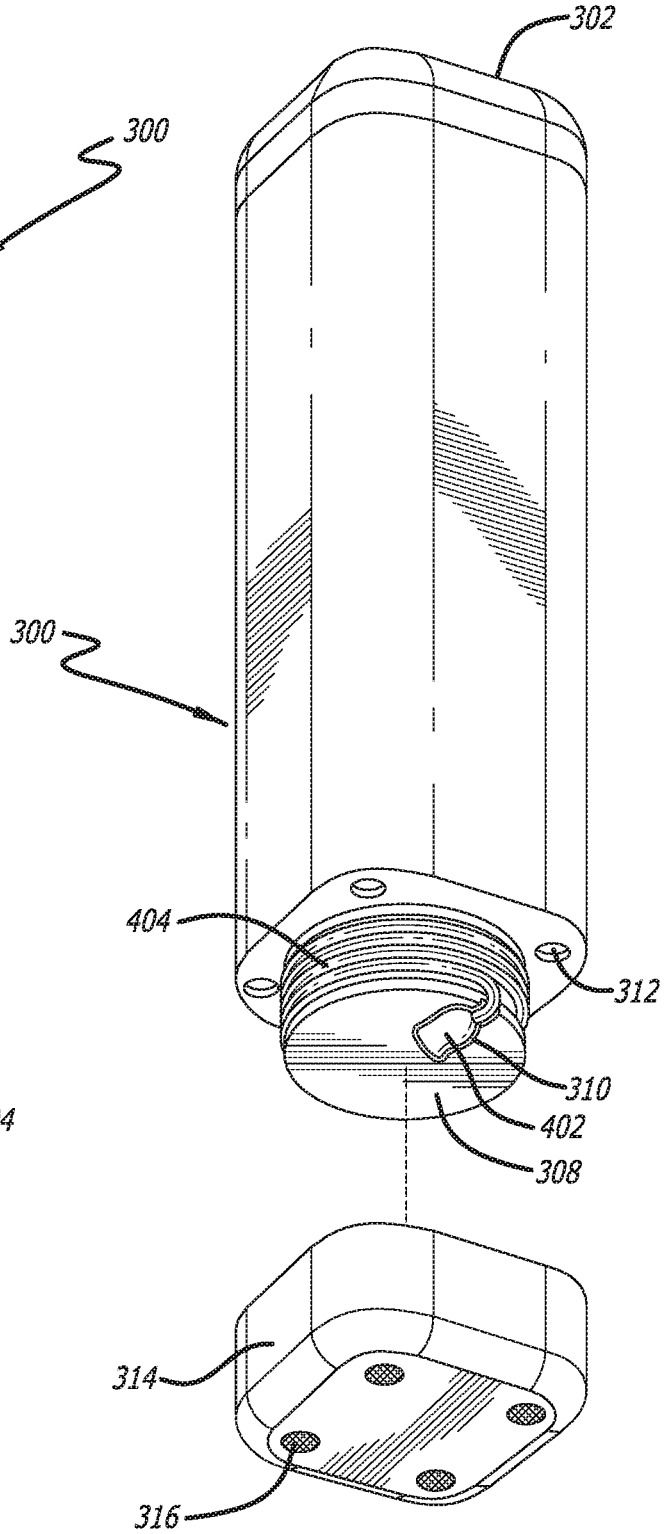
FIG. 11 is a perspective bottom end view of the storage case of FIG. 8 with the bottom cover removed showing a cleaning element and a spool for holding the cleaning element.

As shown in FIGS. 10 and 11, squeegee 402 and cable 404 can be stored in a designated area at the bottom of storage case 300, A spool 308 is provided for coiling cable 404 of cleaning element 400. A recess 310 is provided for receiving squeegee 402 for storage therein. Storage case 300 preferably includes drainage apertures 312 in communication with cavity 306 to permit drainage of any fluids present within cavity 306 from straw 100. A bottom cover 314 is provided to enclose spool 308 and cleaning element 400 within storage case 300. Bottom cover 314 can include one or more drainage openings 316 to permit drainage of any liquids out of storage case 300 and allow air drying of the interior and straw 100 contained therein. A closure to block drainage openings 316 can be provided to prevent drainage of any liquids when it is not desirable, such as when storage case 300 is in a pocket or a purse for example.

In a preferred embodiment, the storage case can be made from and include materials including for example: recycled materials, bio-plastics, plant-based plastics, woods, metals, composite materials, plant-based composite such as for example a wheat-flaxseed-bamboo based composite and others, recycled ABS plastic injection molded materials, metal hinges, neodymium magnets, and glue. It is appreciated that other materials suitable for the intended purpose of forming a drinking straw and storage case are contemplated to be within the scope of the present invention.

Figure 12:
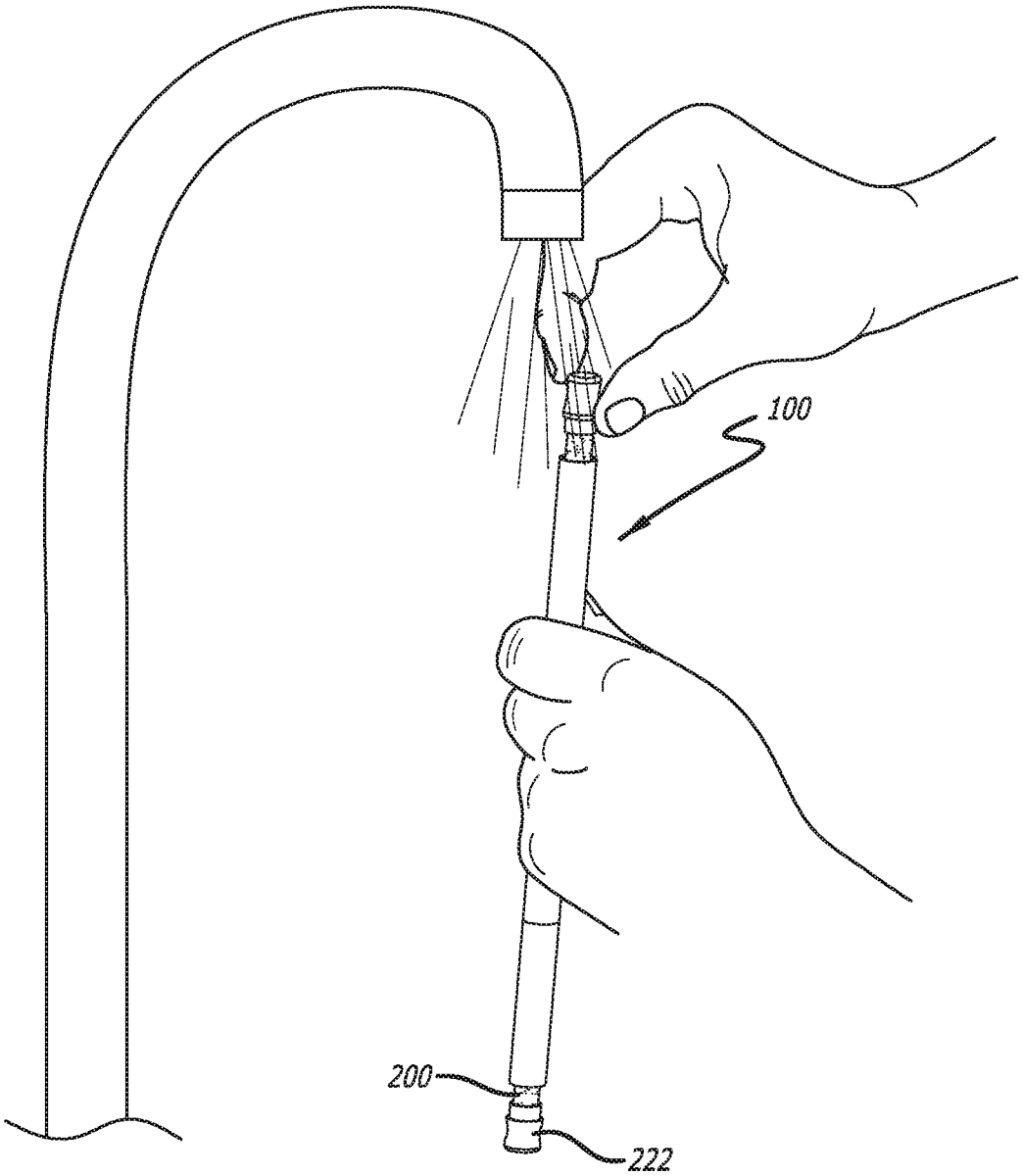
FIG. 12 is an elevational side view of the straw of FIG. 1 being washed under a water faucet with the internal tubing partially extending from the straw.

Referring to FIGS. 5, 6, and 12, straw 100 can be washed by pulling on tips 220 and 222 to extend internal tubing 200 from with external tube 102 to create a space between internal tubing 200 and hollow interior 110 of external tube 102. Water can then be run (as represented by arrows A in FIG. 6) through ends 106 and 108 of external tube 102 to clean out any debris or liquid present between internal tubing 200 and external tube 102 and between tubular segments 104. As shown in FIGS. 6 and 12, water from a faucet can be run through the ends and along the length of straw 100 to flush out any debris.

Figure 15:
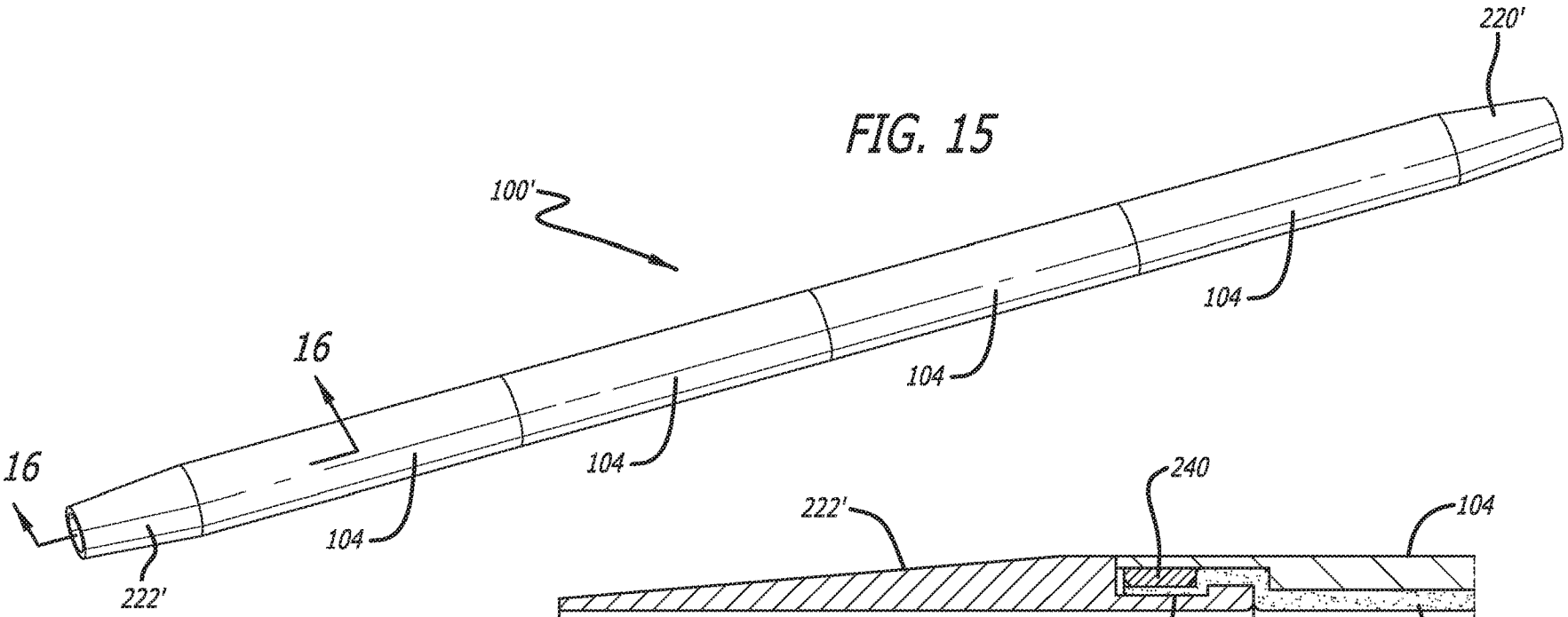
FIG. 15 is a side perspective view of another embodiment of a straw of the present invention in an extended configuration.
Figure 16:
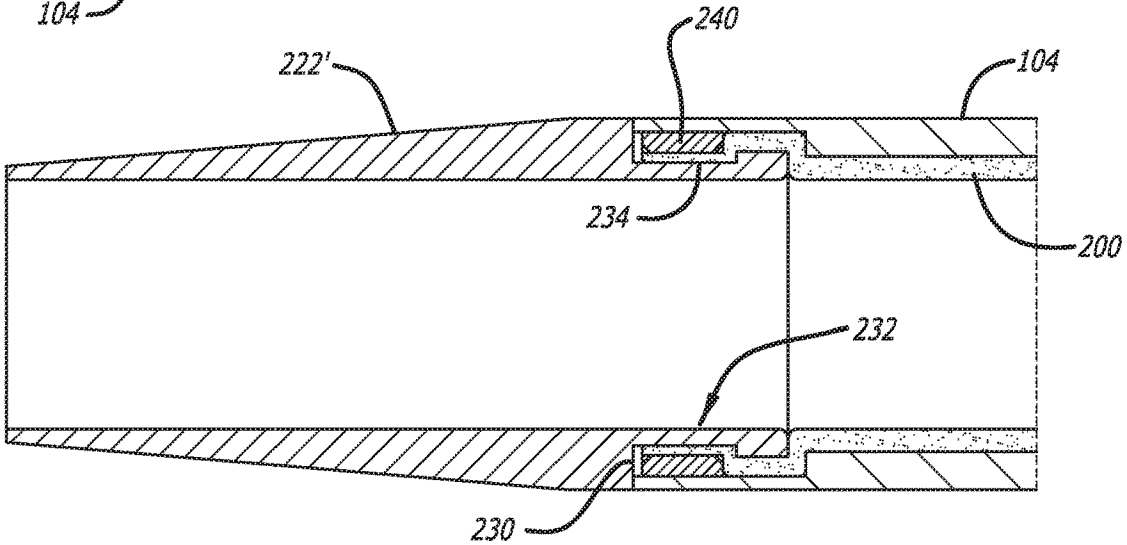
FIG. 16 is an enlarged cross sectional view along lines 16-16 of FIG. 15.

Referring to FIGS. 15 and 16, another preferred embodiment of straw 100' is shown with proximal tip 220' and distal tip 222' connected to respective ends 106 and 108 of external tube 102. Each of proximal tip 220' and distal tip 222' has a shoulder 230, a reduced diameter portion 232 configured to be inserted into an end 106, 108 of external tube 102, and a notched area 234 for receiving a securing band 240. Reduced diameter portion 232 is at least partially inserted into passageway 206 of internal tubing 200 and securing band 240 is positioned over internal tubing 200 and over the notched area 234 to clamp and secure internal tubing 200 to distal tip 222' in a similar manner to a hose clamp. Internal tubing 200 is held under desired tension to maintain tubular segments 104 in the extended configuration while permitting the folding of straw 100 to the folded configuration when desired as described herein. A user can pull on the distal tip 222' to stretch internal tubing 200 so that it partially extends outside of external tube 102 for cleaning purposes as discussed above. Alternatively, internal tubing 200 can have a stopper on either end of internal tubing 200. Stoppers function to hold tubular segments 104 around internal tubing 200 without slipping off.

Figure 17:
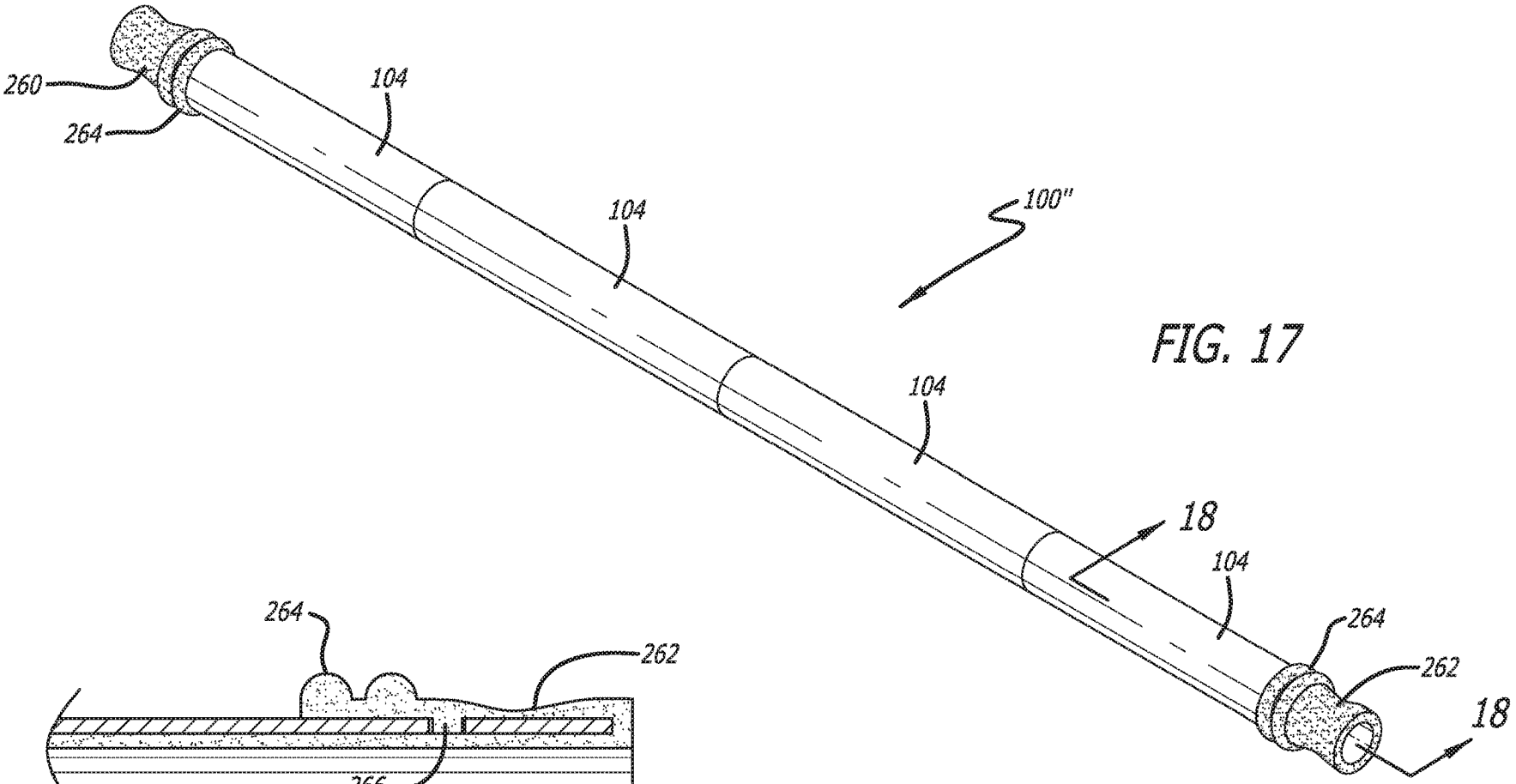
FIG. 17 is a side perspective view of another embodiment of a straw of the present invention in an extended configuration.
Figure 18:
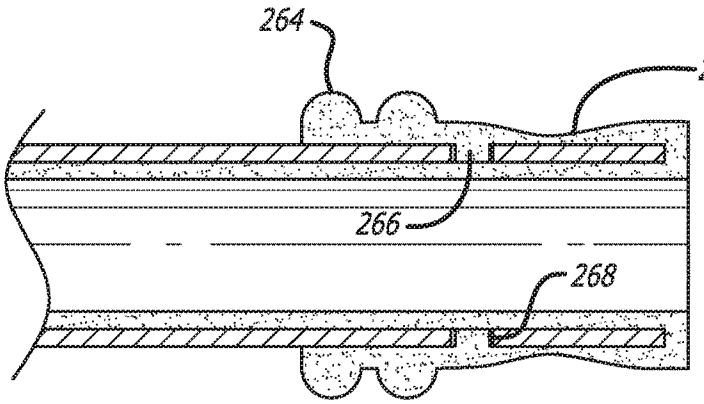
FIG. 18 is an enlarged cross sectional view along lines 18-18 of FIG. 17.
Figure 19:
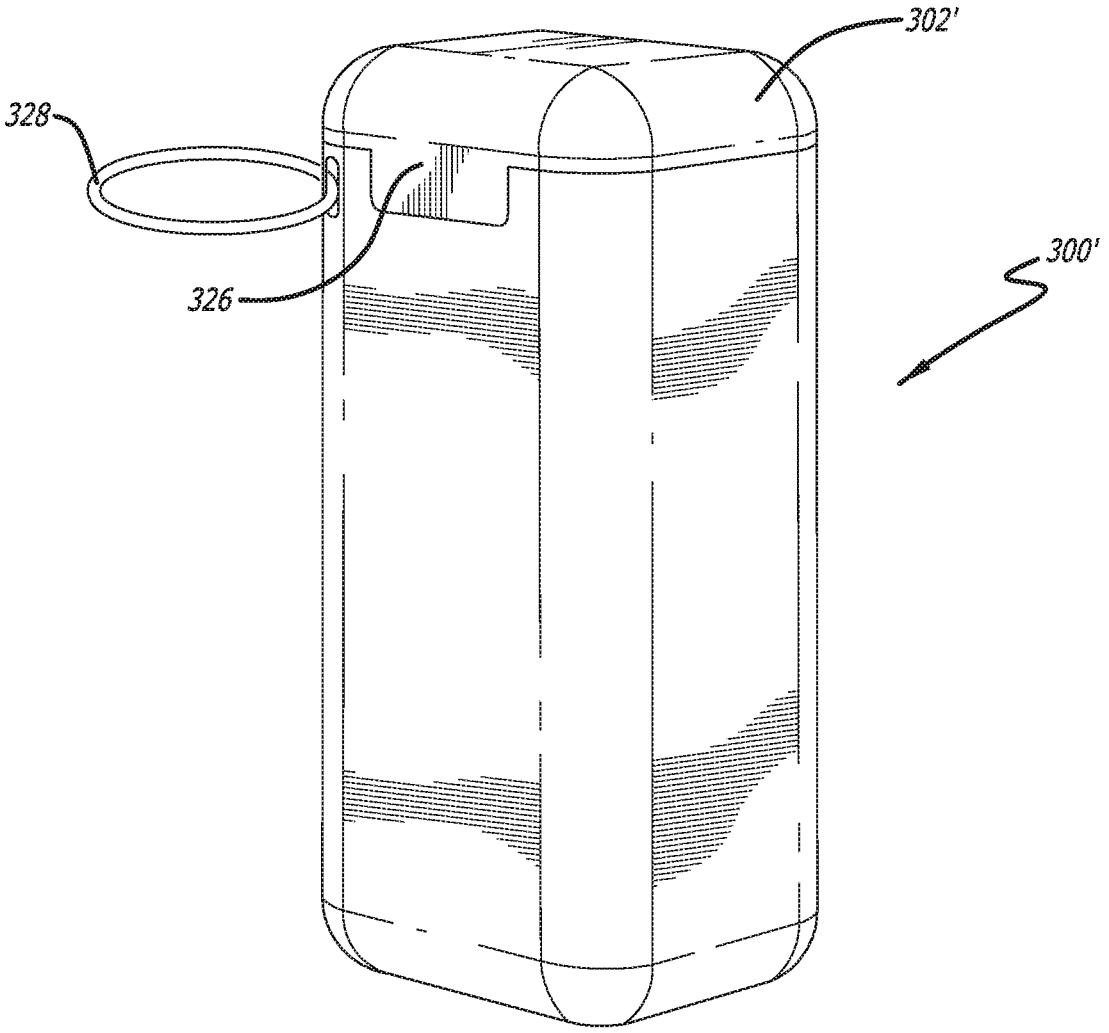
FIG. 19 is a perspective side view of another embodiment of the storage case.

Referring to FIGS. 17 and 18, another embodiment of straw 100" is shown with internal tubing 200 extending out of ends 106 and 108 of external tube 102, folded back, and rolled over a portion of the exterior of external tube 102. The folded back and rolled over portion of internal tubing 200 is secured to external tube 102 with at least one O-ring 264, As shown in FIG. 18, internal tubing 200 can also include a tab 266 extending from its surface and for insertion into a notch 268 in tubular segment 104 to further secure internal tubing 200 to external tube 102. The folded back and rolled over portion of internal tubing 200 also function as rubber tips at the ends of external tube 102. At each end of internal tubing 200, the material folds back on itself preferably creating a space for a tubular segment 104 to slide into. This prevents the tubular segments 104 from being dislodged and falling off of internal tubing 200, It is appreciated that the feature of having the material fold back on itself is only one preferred way of accomplishing this function, Possible other configurations and shapes could include, for example, a round "donut" shape on the end. There could also be channels in the rigid segments where a silicone ridge could slip into. Other configurations suitable for the intended purpose are contemplated. Another preferred design element of flexible internal tubing 200 includes raised ridges on the exterior of internal tubing 200 that would fit into mating depressed channels or holes formed in tubular segments 104. The function of these corresponding channels and ridges would be so that tubular segments 104 do not rotate around flexible internal tubing 200 individually, thus potentially misaligning tubular segments 104 and skewing any printed image or design present on the exterior of tubular segments 104 rendering an incorrect display.

Figure 20:
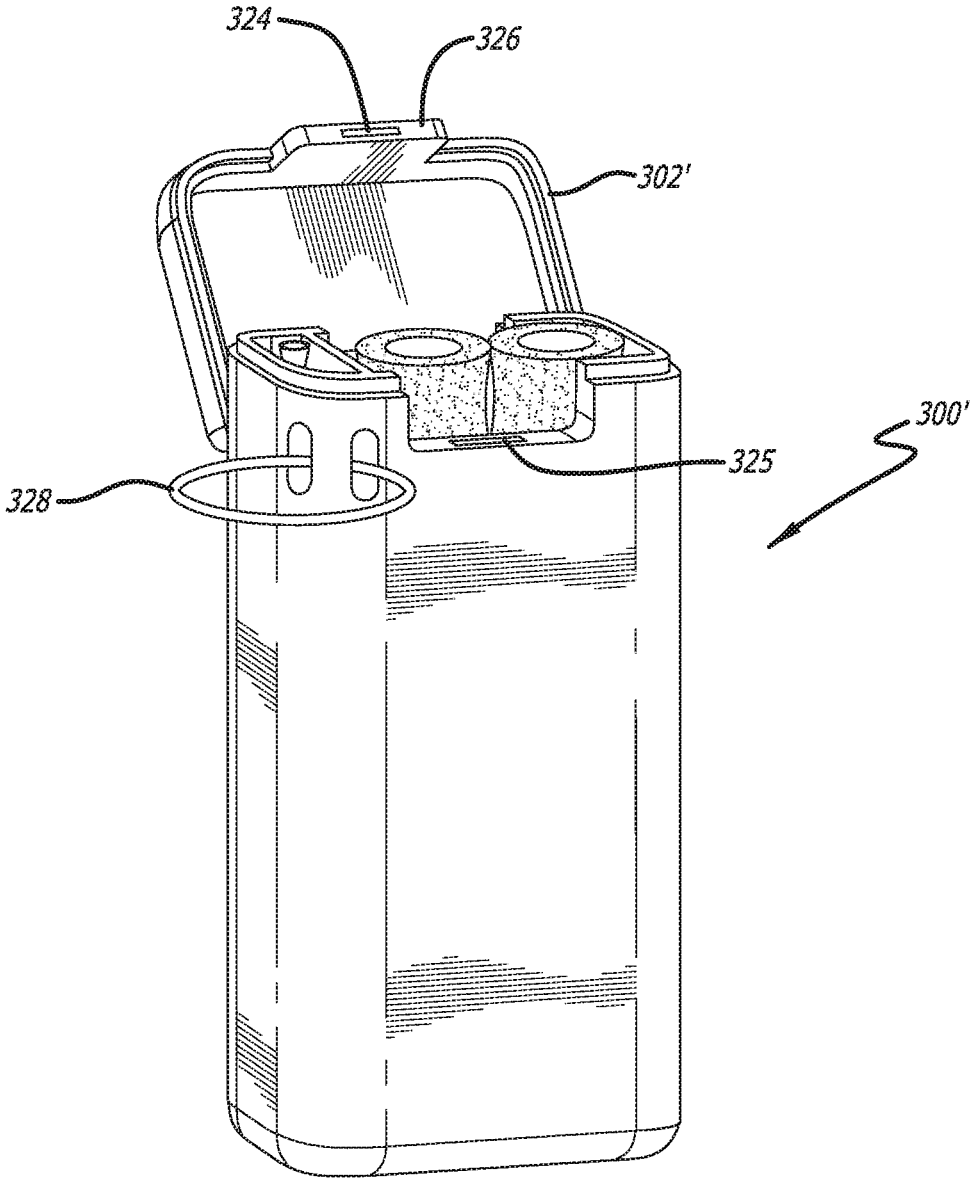
FIG. 20 is a perspective front view of the storage case of FIG. 19 in an open position with a straw in a folded configuration therein.
Figure 21:
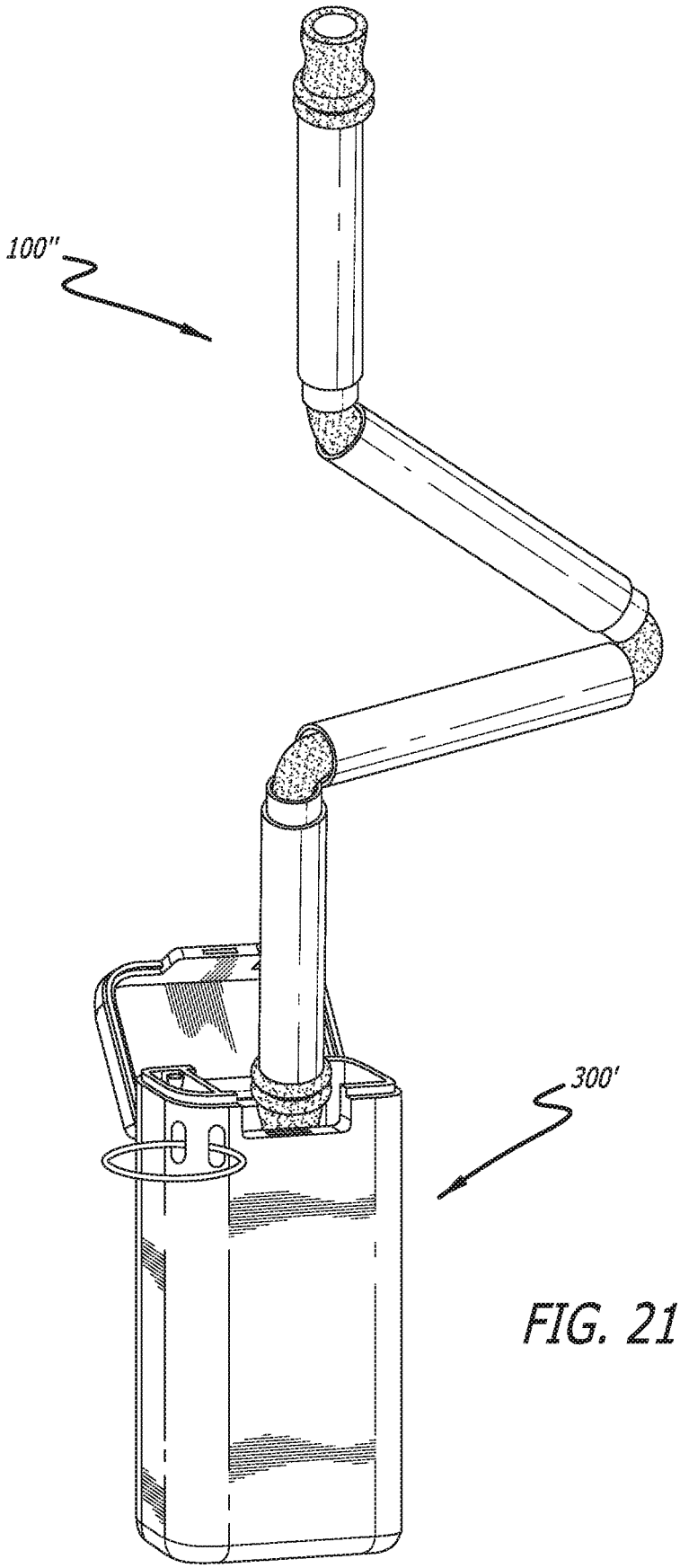
FIG. 21 is a perspective front view of the storage case of FIG. 19 in an open position with a straw in a partially extended configuration being removed therefrom.
Figure 22:
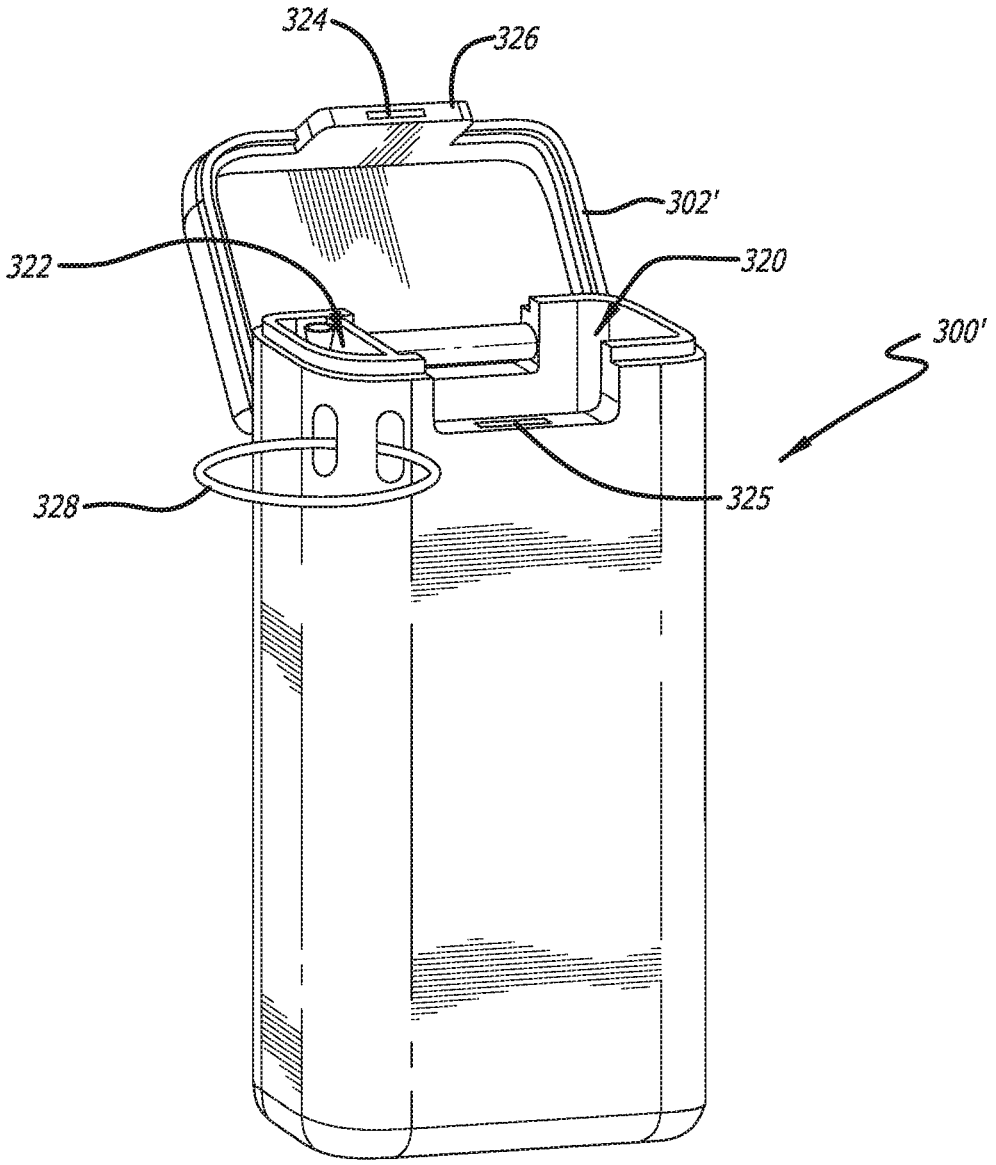
FIG. 22 is a perspective front view of the storage case of FIG. 19 in an open position.

Referring to FIGS. 19-22, another embodiment of storage case 300' is shown having a straw compartment 320 and an adjacent cleaning element compartment 322 for storing cleaning element 400 therein. Straw compartment 320 preferably has a depth of approximately 5.25 cm and cleaning element compartment 322 preferably has a depth of approximately 5.25 cm. In FIG. 20, straw 100" is shown inserted in a folded configuration in straw compartment 320 and cleaning element 400 inserted in cleaning element compartment 322. In FIG. 21, straw 100" is shown being removed from within straw compartment 320 and returning to the extended configuration. FIG. 22 shows storage case 300' empty with cover 302 in the open position and including a closure tab 326 and a magnet closure 324 for keeping storage case 300 closed, Storage case 300 can also include a key ring 328 for holding keys or attaching to other items. In a preferred embodiment, storage case 300 is approximately 5.5 cm tall. (standard house key is 5 cm). For example, the storage case preferably holds a straw and a cleaning squeegee; keeps cleaning device in place with a magnet; lid hinges open and is kept closed with magnets; easy to open, but won't open by itself; small and easy to store/transport; can be kept on a keyring, in a pocket, purse, for example.

It should be understood that aspects of the embodiments herein generally may be interchanged in whole or in part. The disclosure further includes the individual parts and/or combinations/subassemblies, methods of making the parts, methods of assembling the parts and methods of using the drinking straw, cleaning element, and the storage case.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination.

Although the invention has been described in conjunction with specific embodiments thereof, it is evident that many alternatives, modifications and variations will be apparent to those skilled in the art. Accordingly, it is intended to embrace all such alternatives, modifications and variations that fall within the broad scope of the following claims.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A system for drinking liquids, comprising:

a reusable drinking straw comprising a flexible tube having a proximal end terminating at a first tip, an opposite distal end terminating at a second tip, a plurality of segments disposed between the proximal and distal ends, a hollow interior and a central longitudinal axis passing through said proximal and distal ends, said hollow interior being accessible through said first and second tips, said flexible tube being at least in part constructed of an elastomeric material with an elasticity and foldable at least once along the central longitudinal axis into a plurality of segments from an extended configuration where the plurality of segments are generally coaxially arranged to a folded configuration where the plurality of segments are arranged beside one another, the elasticity of said flexible tube causing said drinking straw to bias itself into the extended configuration when released from the folded configuration; and a storage case configured to contain said drinking straw, said storage case having an internal cavity, said storage case sized and configured to contain within said internal cavity at least said drinking straw in the folded configuration.

2. The system of claim 1, wherein said drinking straw in the extended configuration has a first maximum length and in the folded configuration has a second maximum length that is no greater than one-half the first maximum length of said drinking straw in the extended configuration.

3. The system of claim 1, further comprising a cleaning element configured to clean said hollow interior of said drinking straw.

4. The system of claim 3, wherein said cleaning element has a handle portion terminating at a brush portion, said brush portion and said handle portion being sized and configured to at least in part pass through said hollow interior of said drinking straw to clean said drinking straw.

5. The system of claim 3, wherein said cleaning element is foldable from an extended configuration to a folded configuration for storage.

6. The system of claim 1, wherein the flexible tube is constructed of a material including at least one of plastics, non-recycled plastics, thermoplastic elastomers (TPE), thermoplastic polyurethane (TPU), silicones, natural rubbers including latex, plant-based plastics, recyclable material, and renewable material.

7. The system of claim 1, wherein the cleaning element includes a squeegee sized and configured to pass through said hollow interior in said flexible tubing.

8. The system of claim 1, wherein said storage case includes a first area for storing said drinking straw and a second area for storing said cleaning element.

9. The system of claim 1, wherein the storage case comprises a lid for closing the internal cavity.

10. The system of claim 1, wherein the first and second tips are generally identical.

11. The system of claim 1, wherein at least one of the first and second tips includes a contoured sidewall portion having a diameter smaller than a diameter of a remainder of the flexible tube.

12. The system of claim 1, wherein the flexible tube is foldable at least twice along the central longitudinal axis into the plurality of segments.

13. A reusable drinking straw, comprising:

a flexible tube having a proximal end terminating at a first tip, an opposite distal end terminating at a second tip, a plurality of segments disposed between the proximal and distal ends, a hollow interior and a central longitudinal axis passing through said proximal and distal ends, said hollow interior being accessible through said first and second tips, said flexible tube being at least in part constructed of an elastomeric material with an elasticity and foldable at least twice along the central longitudinal axis into a plurality of segments from an extended configuration where the plurality of segments are generally coaxially arranged to a folded configuration where the plurality of segments are arranged beside one another, the elasticity of said flexible tube causing said drinking straw to bias itself into the extended configuration when released from the folded configuration, wherein the first and second tips are generally identical and each includes a contoured sidewall portion having a diameter smaller than a diameter of a remainder of the flexible tube.

14. The reusable drinking straw of claim 13, wherein said drinking straw in the extended configuration has a first maximum length and in the folded configuration has a second maximum length that is no greater than one-half the first maximum length of said drinking straw in the extended configuration.

15. The reusable drinking straw of claim 13, wherein the flexible tube is constructed of a material including at least one of plastics, non-recycled plastics, thermoplastic elastomers (TPE), thermoplastic polyurethane (TPU), silicones, natural rubbers including latex, plant-based plastics, recyclable material, and renewable material.

16. A method of using a foldable and reusable drinking straw, the method comprising:

providing the drinking straw having:

a flexible tube having a proximal end terminating at a first tip, an opposite distal end terminating at a second tip, a plurality of segments disposed between the proximal and distal ends, a hollow interior and a central longitudinal axis passing through said proximal and distal ends, said hollow interior being accessible through said first and second tips, said flexible tube being at least in part constructed of an elastomeric material with an elasticity;

allowing said drinking straw to bias itself into an extended configuration such that said plurality of segments are substantially coaxially aligned; and folding said drinking straw into a folded configuration such that at least two of said plurality of segments are arranged beside one another for storage.

17. The method of claim 16, further comprising, prior to allowing said drinking straw to bias itself, removing said drinking straw from an internal cavity of a storage case.

18. The method of claim 16, further comprising, after folding said drinking straw, inserting said folded drinking straw into an internal cavity of a storage case for storage.

* * * * *